US007371494B2

(12) United States Patent
Chiba et al.

(10) Patent No.: US 7,371,494 B2
(45) Date of Patent: May 13, 2008

(54) MAGNETIC TONER AND METHOD OF MANUFACTURING MAGNETIC TONER

(75) Inventors: Tatsuhiko Chiba, Kamakura (JP); Michihisa Magome, Shizuoka-ken (JP); Eriko Yanase, Mishima (JP); Takeshi Kaburagi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 565 days.

(21) Appl. No.: 10/938,590

(22) Filed: Sep. 13, 2004

(65) Prior Publication Data

US 2005/0089785 A1 Apr. 28, 2005

(30) Foreign Application Priority Data

Sep. 12, 2003 (JP) ..... 2003-321825

(51) Int. Cl.
*G03G 9/083* (2006.01)

(52) U.S. Cl. ..... 430/106.2; 430/108.4; 430/137.17

(58) Field of Classification Search ..... 430/106.1, 430/106.2, 108.4, 137.17, 137.15
See application file for complete search history.

(56) References Cited

U.S. PATENT DOCUMENTS

| | | | | |
|---|---|---|---|---|
| 4,968,577 | A | 11/1990 | Kohri et al. | |
| 4,973,541 | A | 11/1990 | Kohri et al. | |
| 5,672,454 | A | 9/1997 | Sasaki et al. | 430/106.6 |
| 5,721,433 | A | 2/1998 | Kosaka | 250/573 |
| 5,750,302 | A | 5/1998 | Ogawa et al. | 430/106.6 |
| 6,447,969 | B1 | 9/2002 | Ito et al. | 430/106.2 |
| 6,465,144 | B1 | 10/2002 | Hashimoto et al. | 430/106.1 |
| 6,596,452 | B2 | 7/2003 | Magome et al. | 430/106.2 |
| 6,635,398 | B1 | 10/2003 | Komoto et al. | 430/108.23 |
| 6,638,674 | B2 | 10/2003 | Komoto et al. | 430/106.1 |
| 6,653,035 | B2 | 11/2003 | Komoto et al. | 430/106.1 |
| 2002/0055052 | A1 | 5/2002 | Komoto et al. | 430/108.22 |
| 2002/0115011 | A1 | 8/2002 | Komoto et al. | 430/125 |
| 2003/0064309 | A1 | 4/2003 | Komoto et al. | 430/106.1 |
| 2003/0108807 | A1* | 6/2003 | Hohner et al. | 430/108.1 |

FOREIGN PATENT DOCUMENTS

| | | |
|---|---|---|
| EP | 1283450 A2 * | 2/2003 |
| JP | 60-3647 | 1/1985 |
| JP | 63-89867 | 4/1988 |
| JP | 1-259369 | 10/1989 |
| JP | 1-259372 | 10/1989 |
| JP | 03-282556 | 12/1991 |
| JP | 7-209904 | 8/1995 |
| JP | 8-136439 | 5/1996 |
| JP | 9-319137 | 12/1997 |
| JP | 2001-312097 | 11/2001 |
| JP | 2002-251037 | 9/2002 |

OTHER PUBLICATIONS

Patent Abstracts of Japan for JP 03-282556, Dec. 12, 1991.

* cited by examiner

*Primary Examiner*—Janis L. Dote
(74) *Attorney, Agent, or Firm*—Fitzpatrick, Cella, Harper & Scinto

(57) ABSTRACT

The present invention provides a magnetic toner which is hardly influenced by an environment, and with which an image with high quality and excellent resolution can be stably even under low humidity. In the magnetic toner of present invention:

I) a ratio of an iron element content to a carbon element content present on the toner particle surface is less than 0.0010;

II) 50 number % or more of toner particles satisfy a relationship of $D/C \leqq 0.02$ (C: projected area diameter of toner particles, D: minimum value for a distance between a magnetic iron oxide fine particle and the toner particle surface); and III) 40-95 number % of toner particles satisfy a structure where 70 number % or more of the magnetic iron oxide fine particles in the respective toner particles are present up to a depth of 0.2 time as far as C from the toner particle surface.

24 Claims, 3 Drawing Sheets

MAGNETIC TONER AND METHOD OF MANUFACTURING MAGNETIC TONER

BACKGROUND OF THE INVENTION

1. Field of the Invention

The present invention relates to a magnetic toner used for developing an electrostatic image which is formed according to an image forming method such as an electrophotographic method, an electrostatic recording method, a magnetic recording method, or a toner jet recording method.

2. Description of the Related Art

A large number of methods have been conventionally known as electrophotographic methods. A general electrophotographic method involves: forming an electrostatic latent image on an electrostatic image bearing member (hereinafter, referred to as "photosensitive member") using a photoconductive substance with various means; developing the latent image with toner to obtain a visible image (toner image); transferring the toner image onto a recording medium such as paper as required; and fixing the toner image onto the recording medium by means of heat, pressure, or the like to obtain a copied product.

Of such electrophotographic methods, a jumping development method using magnetic toner has been extensively used as a method with which a high-definition image with little fogging can be obtained. The jumping development method involves: applying a thin layer of insulating magnetic toner to a developer bearing member; frictionally charging the toner; and bringing the toner extremely close to (but not in contact with) an electrostatic latent image to be opposite to the latent image through the action of a magnetic field, to thereby develop the image.

However, a development method using magnetic toner inevitably poses a problem owing to the magnetic toner to be used. The problem is such that the flowability, environmental stability, and frictional chargeability of the toner reduce because a considerable amount of magnetic material in fine powder form is mixed and dispersed in the toner and part of the magnetic material is exposed to the toner particle surface. As a result, during long-term use, the magnetic material peels off the toner particles owing to the rubbing of toner particles with each other or the rubbing between a toner particle and a regulating member. Thus, the toner deteriorates, with the result that image failures such as a reduction in image density and uneven in density called sleeve ghost occur.

Many propositions have been conventionally made on the deterioration of image properties involved in the exposure of a magnetic material in terms of the toner structure.

For example, a special toner has been reported, in which only a specific part inside the particles contains a magnetic material particle. To be concrete, the special toner is a toner for pressure fixation manufactured through 2 to 3 steps including: the step of manufacturing a core particle; the step of allowing a magnetic material to dry-adhere to the core particle; and the step of forming a shell layer after the dry-adhesion, in which the magnetic material is present only in an intermediate layer of the toner particles (see JP 60-003647 A and JP 63-089867 A). A toner has also been reported, which is structured such that a resin layer having no magnetic material particles is formed in the vicinity of the toner particle surface to have a thickness equal to or greater than a predetermined thickness (see JP 07-209904 A).

However, it has been recently found out that a toner of such a form poses several problems in achieving an increase in image quality when the toner has a small average particle diameter, for example, an average particle diameter of 10 μm or less. One of the problems is that charge up easily occurs under a low-temperature and low-humidity environment. Such a toner as one described above in which only a specific part inside the particles contains a magnetic material particle has essentially no magnetic material present on the toner surface, so that the toner surface is composed of a resin. According to the studies made by the inventors of the present invention, the toner particle surface has a high resistance and directly reflects the charging property of the resin. Therefore, charge up is remarkable as the toner particle diameter reduces or the toner specific surface area increases.

In addition, each of JP 2001-312097 A (U.S. Pat. No. 6,447,969) and JP 2002-251037 A (U.S. Pat. No. 6,465,144) describes a magnetic toner manufactured by a polymerization method in which no magnetic material is present on the surface of the toner particles but a magnetic material is present in the vicinity of the toner particle surface. However, neither of those prior arts has made an investigation into embedding of an external additive into toner particles, so that the durability is susceptible to improvement.

In recent years, analog printers and analog copying machines have been gradually replaced with digital printers and digital copying machines. Such printers and copying machines have been strongly required to obtain high-resolution images excellent in latent image reproducibility, and to allow an increase in print speed and a reduction in power consumption.

A printer is taken as an example here. A ratio of power consumption at the fixation step to the total power consumption is considerably large, so that the power consumption increases with increasing fixation temperature. Furthermore, a problem such as curling of printed-out paper occurs with increasing fixation temperature. In view of such a circumstance, a reduction in fixation temperature has been strongly required.

To cope with such requirements, many investigations have been conventionally made into a reduction in fixation temperature of toner. Many propositions have been made on a substance having low softening point to be added to toner. For example, it has been reported that the dispersibility of a magnetic material in toner is increased and, at the same time, the fixability and offset resistance of the toner are improved by means of a special approach in which the magnetic material surface is treated with a substance having low softening point (see JP 09-319137 A, JP 01-259369 A, and JP 01-259372 A).

However, the compatibility between the low-temperature fixability and offset resistance of the toner is still susceptible to improvement even when such a magnetic material is used, specially an improvement in fixability has been insufficient. In particular, when a process speed is high, a time period during which the toner and a fixing unit are in contact with each other at the time of fixation is extremely short, so that the toner receives a limited heat quantity. Consequently, toner to be used in a high-speed printer requires a further reduction in fixation temperature.

SUMMARY OF THE INVENTION

An object of the present invention is to provide a magnetic toner that has solved the above problems. That is, an object of the present invention is to provide a magnetic toner which is hardly influenced by an environment, which has stable charging performance, which provides a high image density even in long-term use, in which the occurrence of fogging is suppressed, and which is excellent in image reproducibility.

Another object of the present invention is to provide a magnetic toner with which an image can be stably formed even under a low-temperature and low-humidity environment, and which has few image defects such as fogging resulting from the deterioration of chargeability of toner at the time of durable use.

Still another object of the present invention is to provide a magnetic toner which provides a sufficient image density particularly in a fine isolated dot, which provides high image quality, and the consumption of which is low, and to provide a method of manufacturing the toner.

The inventors of the present invention have made extensive studies on the uniformization and stabilization of chargeability of a magnetic toner particularly under a low-temperature and low-humidity environment. As a result, the inventors have found that the following toner is excellent in image property such as developability or transferability, has improved durability, and, in particular, has a high coloring power, so that the toner consumption can be reduced. In the toner, no magnetic iron oxide fine particles are exposed to the toner particle surface and magnetic iron oxide fine particles are concentrated in the vicinity of the toner particle surface. Thus, the toner of the present invention has been completed.

That is, according to one aspect of the present invention, there is provided a magnetic toner comprising toner particles each containing at least a binder resin and a magnetic iron oxide fine particle, in which:

I) a ratio (B/A) of an iron element content (B) to a carbon element content (A) present on the surface of the toner particle measured by X-ray photoelectron spectroscopy is less than 0.0010;

II) when a projected area diameter of toner particles obtained through cross-section observation of the toner particles using a transmission electron microscope (TEM) is denoted by C and a minimum value for a distance between a magnetic iron oxide fine particle and the toner particle surface is denoted by D, toner particles each satisfying a relationship of $D/C \leqq 0.02$ are present in an amount of 50% by number or more; and III) in the cross-section observation of the toner particles, toner particles, which satisfy a structure where 70% by number or more of the magnetic iron oxide fine particles in the respective toner particles are present up to a depth of 0.2 time as far as the projected area diameter C from the toner particle surface, are present in an amount of 40 to 95% by number.

According to another aspect of the present invention, there is provided a method for manufacturing a magnetic toner comprising toner particles each containing at least a binder resin and a magnetic iron oxide fine particle, the method comprising the steps of:

1) preparing a polymerizable monomer composition containing at least a polymerizable monomer, a magnetic iron oxide fine particle, and a polar compound;

2) dispersing the prepared polymerizable monomer composition into an aqueous medium for granulation; and 3) subjecting the granulated polymerizable monomer composition to suspension polymerization to obtain toner particles, in which in the resultant magnetic toner:

I) a ratio (B/A) of an iron element content (B) to a carbon element content (A) present on the surface of the toner particle measured by X-ray photoelectron spectroscopy is less than 0.0010;

II) when a projected area diameter of toner particles obtained through cross-section observation of the toner particles using a transmission electron microscope (TEM) is denoted by C and a minimum value for a distance between a magnetic iron oxide fine particle and the toner particle surface is denoted by D, toner particles each satisfying a relationship of $D/C \leqq 0.02$ are present in an amount of 50% by number or more; and III) in the cross-section observation of the toner particles, toner particles, which satisfy a structure where 70% by number or more of the magnetic iron oxide fine particles in the respective toner particles are present up to a depth of 0.2 time as far as the projected area diameter C from the toner particle surface, are present in an amount of 40 to 95% by number.

BRIEF DESCRIPTION OF THE DRAWINGS

Other objects and advantages of the present invention will become apparent during the following discussion in conjunction with the accompanying drawings, in which.

DETAILED DESCRIPTION OF THE PREFERRED EMBODIMENTS

Figure 1:
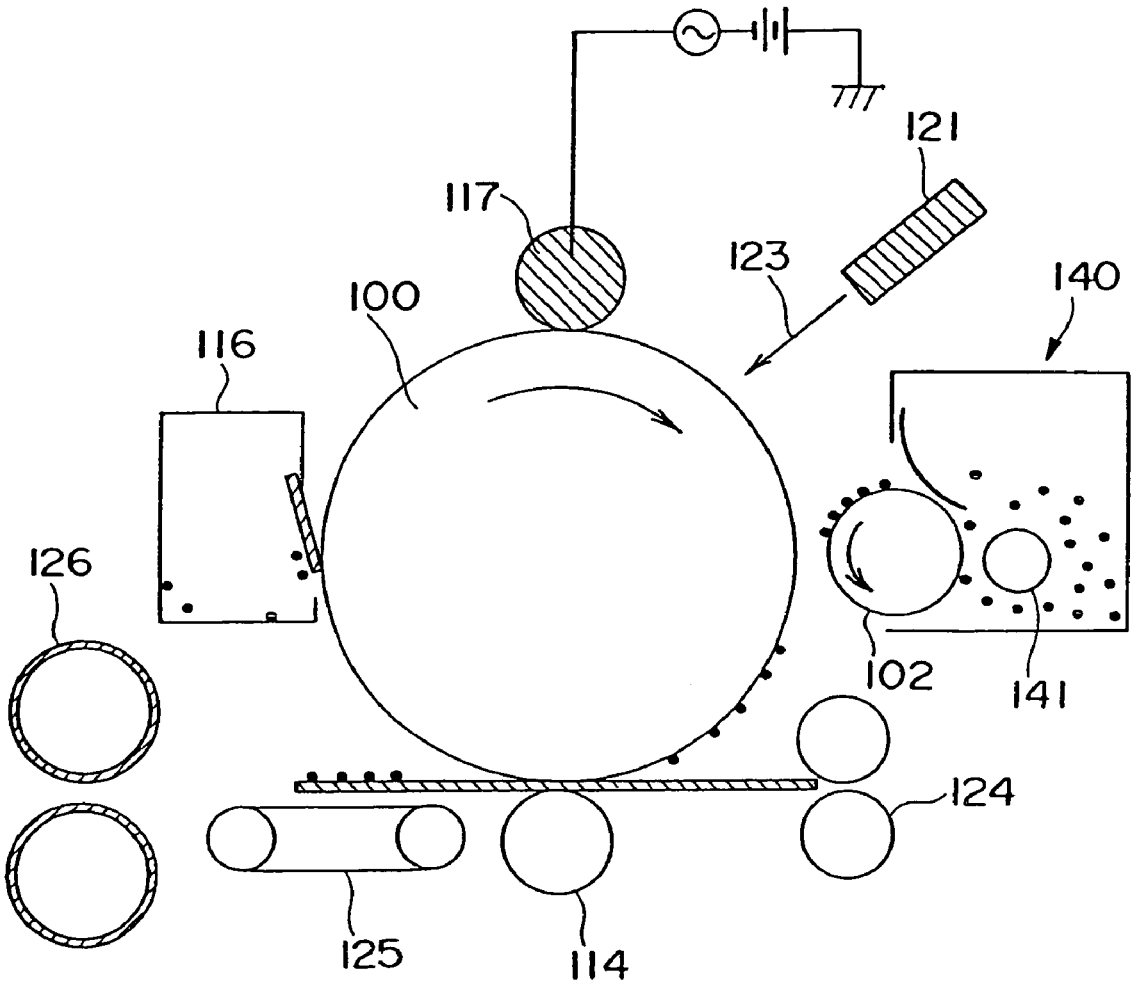
FIG. 1 is a schematic sectional view showing an example of an image forming apparatus that can suitably use a magnetic toner of the present invention, the apparatus employing a non-contact development method.

A feature of the present invention is that a certain amount of the following toner is present. In the toner, nearly no magnetic iron oxide fine particles are exposed to the toner particle surface, and the toner has a structure where magnetic iron oxide fine particles are concentrated in the vicinity of the toner particle surface.

That is, the magnetic toner (hereinafter, referred to as "toner") of the present invention is characterized in that:

I) a ratio (B/A) of an iron element content (B) to a carbon element content (A) present on the surface of the toner particle measured by X-ray photoelectron spectroscopy, is less than 0.0010;

II) when a projected area diameter of toner particles obtained through cross-section observation of the toner particles using a transmission electron microscope (TEM) is denoted by C and a minimum value for a distance between a magnetic iron oxide fine particle and the toner particle surface is denoted by D, toner particles each satisfying a relationship of $D/C \leqq 0.02$ are present in an amount of 50% by number or more; and III) in the cross-section observation of the toner particles, toner particles, which satisfy a structure where 70% by number or more of the magnetic iron oxide fine particles in the respective toner particles are present up to a depth of 0.2 time as far as the projected area diameter C from the toner particle surface, are present in an amount of 40 to 95% by number.

Such a distribution state of the magnetic iron oxide fine particles remarkably improves the chargeability and durability of the magnetic toner. The reason for this is described below.

The use of such a magnetic toner as one having the ratio (B/A) of less than 0.0010, preferably less than 0.0005 in which nearly no magnetic iron oxide fine particles are exposed to the toner particle surface provides excellent environmental stability of charging because there is substantially no effect of moisture absorption into the magnetic iron oxide fine particles. In addition, even in a method for forming an image in which the toner is brought into press contact with the surface of an electrostatic image bearing member (photosensitive member) by a charging member or a transferring member, the toner hardly shaves the surface of the electrostatic image bearing member. As a result, abrasion of the electrostatic image bearing member and toner fusion can be remarkably reduced for a long period of time.

In addition, magnetic iron oxide fine particles each having a low resistance are present in the vicinity of the toner particle surface in such a manner that toner particles each satisfying a relationship of $D/C \leqq 0.02$ are present in an amount of 50% by number or more, preferably 65% by number or more, more preferably 75% by number or more. As a result, in spite of the fact that the toner particle surface is composed substantially only of a resin, charge up particularly under a low-temperature and low-humidity environment is suppressed, and a reduction in image density, fogging at the time of durable use are reduced.

Furthermore, the toner is allowed to have a toner structure having a capsule intermediate layer (hereinafter, the layer may be referred to as "mag intermediate layer") composed substantially only of magnetic iron oxide fine particles. In the toner structure, toner particles, which contain 70% by number or more of the magnetic iron oxide fine particles up to a depth of 0.2 time as far as the projected area diameter C from the toner particle surface, are present in an amount of 40 to 95% by number, preferably 60 to 95% by number, more preferably 70 to 95% by number. In this case, the rigidity of the toner drastically increases. Therefore, even when an external additive is added to the toner particles, the toner is excellent in durability because, for example, embedding of the external additive in the toner particles is suppressed. In addition, the toner of the present invention having a capsule intermediate layer of magnetic iron oxide fine particles provides a high coloring power when the toner is fixed because, in the toner particle, the magnetic material density is locally high along the peripheral surface of the toner particles.

When the ratio (B/A) is 0.0010 or more, moisture absorption into magnetic iron oxide fine particles or charge leak easily occurs, so that fogging or a reduction in image density due to durable use particularly under a high-temperature and high-humidity environment easily occurs. Furthermore, the surface of an electrostatic image bearing member, in other words a photosensitive member, is easily shaved by exposed magnetic iron oxide fine particles.

When toner particles each satisfying a relationship of $D/C \leqq 0.02$ are present in an amount of less than 50% by number, no magnetic iron oxide fine particles are present outside the border of $D/C=0.02$ in at least the majority of toner particles. As a result, the surface of the toner particle has a high resistance and the charging property of the resin is directly reflected in the chargeability of the toner with ease. Therefore, fogging and a reduction in image density involved in charge up occur under a low-temperature and low-humidity environment.

When the toner particles having the mag intermediate layer (toner particles containing 70% by number or more of the magnetic iron oxide fine particles up to a depth of 0.2 time as far as the projected area diameter C from the toner particle surface) are present in an amount of less than 40% by number, the capsule structure of the magnetic iron oxide fine particles is not enough, and it cannot be said that a good mag intermediate layer is formed. Therefore, the effects of the present invention on the durability and coloring power of the toner are hardly obtained.

When the toner particles having the mug intermediate layer are present in an amount of more than 95% by number, exudation of a wax or the like, which provides a beginning of fixation, hardly occurs. In particular, low-temperature offset easily occurs.

Next, the circularity of the toner of the present invention will be described.

The toner of the present invention preferably has an average circularity of 0.970 or more. In this case, high image quality and high durability are achieved. To achieve high image quality, transfer efficiency needs to be increased to reduce the amount of transfer residual toner in an image portion while toner adhesion needs to be suppressed in a non-image portion. An increase in average circularity of the toner simultaneously satisfies those two needs. In the toner according to the present invention, each toner particle has a sufficient and nearly uniform charging amount, so that those two needs are particularly satisfied.

The toner of the present invention preferably has a weight average particle diameter in the range of 2 to 10 μm.

When the weight average particle diameter of the toner exceeds 10 μm, reproducibility of a fine dot image reduces. On the other hand, when the weight average particle diameter of the toner is smaller than 2 μm, deterioration of the external additive or the like easily occurs as the flowability reduces, so that problems such as fogging and a low image density due to insufficient charging easily occur. The improving effects on the charging stability, flowability, or the like of the toner of the present invention are more remarkable when the weight average particle diameter is in the range of 3 to 10 μm. The weight average particle diameter is more preferably in the range of 3.5 to 8.0 μm for further increasing image quality.

Next, a method of manufacturing a toner of the present invention will be described.

The toner of the present invention can be manufactured according to a pulverization method. However, the pulverization method is disadvantageous in terms of yield and cost because the pulverization method must undergo multiple steps to satisfy the state of presence of magnetic iron oxide fine particles in the present invention.

In contrast, a method of manufacturing a toner involving directly polymerizing a monomer system (polymerizable monomer composition) in an aqueous medium (hereinafter, referred to as "polymerization method") is preferable. This is because localization/separation easily occurs between a polar component and a nonpolar component owing to an affinity of the polymerizable monomer composition for the aqueous medium, so that the magnetic material structure necessary for the present invention can be obtained by one step.

When the toner is manufactured according to the method involving direct polymerization in an aqueous medium (hereinafter, referred to as "direct polymerization method"), magnetic iron oxide fine particles subjected to a uniform and sophisticated hydrophobic treatment are used, and a polar substance having a specific saponification value is added to the monomer composition. As a result, the state of presence of the magnetic iron oxide fine particles in the toner can be easily controlled to a desirable one.

The use of the magnetic iron oxide fine particles the surface of which is subjected to a hydrophobic treatment can suppress not only the exposure of the magnetic iron oxide fine particles to the toner particle surface but also a reduction in chargeability of the toner.

The magnetic iron oxide fine particles used as a magnetic material in the toner of the present invention are preferably made uniformly hydrophobic at an extremely high level. Subjecting the magnetic iron oxide fine particles to a uniform treatment enables the behavior of the magnetic iron oxide fine particles to be precisely controlled, whereby a special state of presence necessary for the present invention can be satisfied.

Methods of treating the magnetic iron oxide fine particle surface with a coupling agent are classified into a dry treatment and a wet treatment. Although the present invention may employ any one of the dry and wet treatments, a wet treatment in an aqueous medium is preferable. The reason for this is as follows. Coalescence of the magnetic iron oxide fine particles subjected to the wet treatment hardly occurs as compared to that subjected to the dry treatment in a gas phase. In addition, charge repulsion occurs between the magnetic iron oxide fine particles owing to a hydrophobic treatment, so that the magnetic iron oxide fine particles are subjected to a surface treatment with a coupling agent nearly in a primary particle state. As a result, the magnetic iron oxide fine particles can be made uniformly hydrophobic at a high level. In the case of the dry treatment, the magnetic iron oxide fine particle surface can be treated on the same device as that suitable for treatment with a substance having low softening point to be described later.

Examples of a coupling agent preferably used for treating the magnetic iron oxide fine particle surface in the present invention include a silane coupling agent and a titanium coupling agent. A silane coupling agent, which is represented by the following general formula (A), is more preferably used.

$$R_mSiY_n \quad (A)$$

[In the formula, R represents an alkoxy group, m represents an integer of 1 to 3, Y represents an alkyl group, a vinyl group, an acryl group, a methacryl group, a phenyl group, an amino group, an epoxy group, a mercapto group, or a derivative thereof, and n represents an integer of 1 to 3.]

Examples of the silane coupling agent include vinyl trimethoxysilane, vinyl triethoxysilane, γ-methacryloxypropyl trimethoxysilane, vinyl triacetoxysilane, methyl trimethoxysilane, methyl triethoxysilane, isobutyl trimethoxysilane, dimethyl dimethoxysilane, dimethyl diethoxysilane, trimethyl methoxysilane, hydroxypropyl trimethoxysilane, phenyl trimethoxysilane, n-hexadecyl trimethoxysilane, and n-octadecyl trimethoxysilane.

Of the above silane coupling agents, an alkyltrialkoxysilane coupling agent represented by the following general formula (B) is particularly preferably used for the hydrophobic treatment of the magnetic iron oxide fine particle surface.

$$C_pH_{2p+1}—Si—(OC_qH_{2q+1})_3 \quad (B)$$

[In the formula, p represents an integer of 2 to 20 and q represents an integer of 1 to 3.]

In the formula (B), when p is smaller than 2, a hydrophobic treatment can be easily performed, but it becomes difficult to impart sufficient hydrophobicity to the magnetic iron oxide fine particles in some cases. Furthermore, when p is larger than 20, sufficient hydrophobicity can be imparted to the magnetic iron oxide fine particles, but coalescence of the magnetic iron oxide fine particles is remarkable, so that it becomes difficult to sufficiently disperse the magnetic iron oxide fine particles into the toner in some cases. In addition, when q is larger than 3, the reactivity of the silane coupling agent reduces, with the result that the magnetic iron oxide fine particles are insufficiently made to be hydrophobic.

Therefore, it is preferable to use an alkyltrialkoxysilane coupling agent represented by the formula (B), with p representing an integer of 2 to 20 (more preferably, an integer of 3 to 15) and q representing an integer of 1 to 3 (more preferably, an integer of 1 or 2). 0.05 to 20 parts by mass, preferably 0.1 to 10 parts by mass, of the coupling agent are used for treating 100 parts by mass of the magnetic iron oxide fine particles before the treatment.

When magnetic iron oxide fine particles are subjected to a surface treatment with a coupling agent in an aqueous medium, for example, appropriate amounts of the magnetic iron oxide fine particles and the coupling agent are stirred and mixed in the aqueous medium.

An aqueous medium refers to a medium mainly composed of water. Specific examples of the aqueous medium include water itself, water added with a small amount of surfactant, water added with a pH adjustor, and water added with an organic solvent. Preferable examples of the surfactant include nonionic surfactants such as polyvinyl alcohol. The surfactant is desirably added in an amount of 0.1 to 5% by mass with respect to water. Examples of the pH adjustor include inorganic acids such as hydrochloric acid.

The stirring is desirably performed sufficiently by using, for example, a mixer having a stirring blade (specifically, a high-shearing-force mixer such as an Atliter or a TK homomixer) in such a manner that the magnetic iron oxide fine particles become primary particles in the aqueous medium.

The magnetic iron oxide fine particles obtained as described above provide excellent dispersibility in the polymerizable monomer composition because the surface of the particles is made uniformly hydrophobic. As a result, toner particles with uniform content of magnetic iron oxide fine particle can be obtained. In addition, agglomeration property of the magnetic iron oxide fine particles thus treated is low. Accordingly, the exposure of the magnetic iron oxide fine particles from the toner particle surface is satisfactorily suppressed even in the magnetic toner of the present invention in which the magnetic iron oxide fine particles are unevenly distributed in the vicinity of the toner particle surface. The use of such magnetic iron oxide fine particles enables the magnetic toner of the present invention, which has a ratio (B/A) of an iron element content (B) to a carbon element content (A) on the toner particle surface measured by X-ray photoelectron spectroscopy of less than 0.0010, to be obtained. In addition, the uniformization and stabilization of charging of the toner can be achieved. The use of the magnetic toner enables high image quality and high durability to be achieved.

The magnetic iron oxide fine particles used in the magnetic toner of the present invention can be manufactured according to the following method, for example.

An aqueous solution of a ferrous salt such as an aqueous solution of ferrous sulfate is added with an alkali such as sodium hydroxide in an equivalent amount or more with respect to an iron component, to thereby prepare an aqueous solution containing ferrous hydroxide. Air is blown into the prepared aqueous solution while the pH of the solution is maintained at 7 or more (preferably, in the range of 8 to 10). Then, an oxidation reaction of ferrous hydroxide is performed while the aqueous solution is heated to 70° C. or more. Thus, a seed crystal serving as a core for magnetic iron oxide fine particles is produced.

Next, a slurry-like liquid containing the seed crystal is added with about 1 equivalent amount of an aqueous solution containing ferrous sulfate with reference to the addition amount of the alkali. Air is blown into the resultant liquid while its pH is maintained in the range of 6 to 10, to thereby allow an oxidation reaction of ferrous hydroxide to proceed. Thus, magnetic iron oxide fine particles are grown with the seed crystal as a core. As the oxidation reaction proceeds, the pH of the liquid shifts to the acidic side. It is not preferable that the pH of the liquid be less than 6. The pH of the liquid is adjusted at a final stage of the oxidation reaction, and the liquid is sufficiently stirred in such a manner that the magnetic iron oxide fine particles become primary particles. Magnetic iron oxide particles which have been made hydrophobic can be obtained by: sufficiently stirring and mixing the liquid after addition of a coupling agent; filtering the liquid after the stirring; drying the resultant; and lightly crushing the dried product. Alternatively, the following procedure can be also employed. That is, magnetic iron oxide particles obtained by washing and filtration after the completion of the oxidation reaction are redispersed into another aqueous medium without being dried. Then, the pH of the resultant dispersion is adjusted, and a coupling agent is added to the dispersion while the mixture is sufficiently stirred, to thereby perform a coupling treatment.

In any case, untreated magnetic iron oxide fine particles produced in an aqueous solution are preferably made hydrophobic in the state of water-containing slurry before the drying. The reason for this is as follows. When untreated magnetic iron oxide fine particles are dried as they are, coalescence due to agglomeration of the particles inevitably occurs. It is difficult to make a powder in such an agglomerated state uniformly hydrophobic even if the powder is subjected to a wet hydrophobic treatment.

Examples of a ferrous salt used in an aqueous solution of a ferrous salt in manufacturing magnetic iron oxide fine particles include: iron sulfate as a general by-product of manufacturing titanium according to a sulfuric acid method; and iron sulfate as a by-product of washing the surface of a steel plate. In addition to ferrous sulfate, iron chloride or the like can be used.

In the method of manufacturing magnetic iron oxide fine particles using an aqueous solution, an aqueous solution of ferrous sulfate having an iron concentration in the range of 0.5 to 2 mol/l is generally used in view of: prevention of an increase in viscosity at the time of reaction; and solubility of iron sulfate. In general, the particle size of a product tends to be fine as the concentration of iron sulfate decreases. In addition, at the time of the reaction, the magnetic iron oxide fine particles tend to be fine as an air quantity increases and the reaction temperature decreases.

The magnetic iron oxide fine particles used in the toner of the present invention are preferably treated with a substance having low softening point, after the surface treatment with a coupling agent.

The capsule intermediate layer of magnetic iron oxide fine particles in the toner of the present invention, because of its rigidity, tends to inhibit the deformation of the toner and the exudation of a substance having low softening point such as a wax. Therefore, the fixability of the toner is preferably improved with another structure. The following has been heretofore considered. In the first place, a magnetic toner has a large amount of magnetic material mixed and dispersed in it. Therefore, the magnetic material, which has a larger heat capacity than that of a resin, absorbs part of heat received from a fixing unit. Thus, the heat from the fixing unit is not effectively used for the plastic deformation of a binder resin or the melting of a substance having low softening point.

In view of the above, the inventors of the present invention have made extensive studies. As a result, the inventors have found that the use of magnetic iron oxide fine particles treated with a substance having low softening point significantly improves fixability because the substance melts to exude before the magnetic iron oxide fine particles absorb heat received at the time of fixation. Furthermore, in the present invention, a certain amount or more of substance having low softening point is inevitably present in the vicinity of the toner particle surface because the treated magnetic iron oxide fine particles are present in the vicinity of the toner particle surface. As a result, the melting and exudation of the substance having low softening point proceed at a rate higher than the rate at which the magnetic iron oxide fine particles absorb heat from the fixing unit. Thus, excellent low-temperature fixability can be obtained and a range of fixation temperature can be wide.

In the magnetic toner of the present invention, nearly no magnetic iron oxide fine particles are exposed to the toner particle surface, so that the substance having low softening point, with which the magnetic iron oxide fine particles have been treated, is hardly exposed to the toner particle surface. Therefore, a phenomenon in which the substance having low softening point contaminates a toner bearing member or an electrostatic image bearing member to cause image defects does not occur.

The toner of the present invention preferably has an average circularity of 0.970 or more. In this case, toner particles are of nearly spherical shapes and have a single shape, whereby a contact area between the toner and the fixing unit becomes uniform. Consequently, the substance having low softening point can stably exude, with which the magnetic iron oxide fine particles present in the vicinity of the surface of the toner particle of the present invention have been treated. As a result, the toner of the present invention can exert stable fixability even at a high process speed.

The treatment of the magnetic iron oxide fine particles with the substance having low softening point in the toner of the present invention will be described.

The magnetic iron oxide fine particles are inorganic substances while the substance having low softening point is an organic compound. Therefore, it is difficult to uniformly cover the magnetic iron oxide fine particle surface with the substance having low softening point. However, a uniform treatment can be performed in the case where the magnetic iron oxide fine particle surface is treated with a coupling agent according to the above-described method and then with the substance having low softening point. The treatment with the substance having low softening point is poor in uniformity unless the magnetic iron oxide fine particle surface is treated with a coupling agent. In this case, fixability may be poor at a low-temperature fixation.

A conventionally known wax can be used as a substance having low softening point for treating the magnetic iron oxide fine particle surface. Examples of the wax include: petroleum-based waxes such as a paraffin wax, a microcrystalline wax, and petrolatum, and derivatives thereof; a montan wax and derivatives thereof; hydrocarbon waxes obtained by Fischer-Tropsch method and derivatives thereof; polyolefin waxes typified by polyethylene and derivatives thereof; and natural waxes such as a carnauba wax and a candelilla wax, and derivatives thereof. The derivatives as used herein include oxides, block copolymers with vinyl monomers, and graft modified products. The state of dispersion of the magnetic iron oxide fine particles in the toner can be controlled by adjusting the acid value, degree of modification, and the like of the wax. Examples of the wax further include: higher aliphatic alcohols; higher fatty acids or compounds thereof; acid amid waxes; ester waxes; ketones; hardened castor oil and derivatives thereof; plant waxes; and animal waxes.

Each of those substances having low softening point preferably has a top of an endothermic peak in the region of 80 to 150° C. in DSC measurement. The presence of a peak top in this temperature region allows releasability to be effectively exerted while contributing to low-temperature fixability to a large extent. When the peak top is present below 80° C., the substance having low softening point tends to melt owing to heat applied at the time of toner manufacture, so the effect of the surface treatment becomes small. On the other hand, when the peak top is present above 150° C., a hot-offset resistance is high, but the fixation temperature increases. In addition, the substance having low softening point itself becomes rigid, so that it becomes difficult to maintain the uniformity of treatment for the magnetic iron oxide fine particles. This case is not preferable.

0.3 to 15 parts by mass of the substance having low softening point are preferably used for treating 100 parts by mass of the magnetic iron oxide fine particles before the treatment. When the amount of the substance having low softening point used is less than 0.3 part by mass, sufficient fixability cannot be obtained because the amount of the wax which is present in the vicinity of the toner particle surface and exudes instantaneously at the time of fixation is low. Furthermore, it becomes difficult to uniformly treat the magnetic iron oxide fine particle surface. On the other hand, when the amount of the substance having low softening point used exceeds 15 parts by mass, a quantity of heat absorbed by the substance is so large that the low-temperature fixability is impaired.

A device for treating the magnetic iron oxide fine particle surface with a substance having low softening point is preferably a device capable of exerting a shearing force. Examples of such a device that can be particularly preferably used include devices each of which is capable of simultaneously performing shearing, squeeze with a spatula, and compression such as a wheel-type kneader, a ball-type kneader, and a roll-type kneader. Of those, a wheel-type kneader is preferably used in terms of a uniform treatment. The use of a wheel-type kneader enables a treatment in which the magnetic iron oxide fine particle surface is rubbed with a substance having low softening point for adhesion and drawing of the substance. As a result, the magnetic iron oxide fine particle surface can be uniformly covered with the substance having low softening point.

Specific examples of the wheel-type kneader include an edge runner, a multiple mill, a stotzmill, a wet pan mill, a conner mill, and a ring muller. Of those, an edge runner, a multiple mill, a stotzmill, a wet pan mill, and a ring muller are preferable, and an edge runner is more preferable. Specific examples of the ball-type kneader include a vibration mill. Specific examples of the roll-type kneader include an extruder.

In the case where an edge runner is used, it is sufficient to appropriately adjust the treatment conditions in order to uniformly treat/cover the magnetic iron oxide fine particle surface with a substance having low softening point. More specifically, a linear load at a treatment portion is adjusted to fall within the range of 19.6 to 1,960 N/cm (2 to 200 kg/cm), preferably 98 to 1,470 N/cm (10 to 150 kg/cm), more preferably 147 to 980 N/cm (15 to 100 kg/cm). A treatment time is adjusted to fall within the range of 5 to 180 minutes, preferably 30 to 150 minutes. It should be noted that it is sufficient to appropriately adjust the treatment conditions, such that a stirring rate falls within the range of 2 to 2,000 rpm, preferably 5 to 1,000 rpm, more preferably 10 to 800 rpm.

Preferably used in the present invention are hydrophobic and magnetic iron oxide fine particles manufactured as described above.

The amount of magnetic iron oxide fine particles used in the toner of the present invention is preferably 10 to 200 parts by mass, more preferably 20 to 180 parts by mass, still more preferably 40 to 160 parts by mass with respect to 100 parts by mass of binder resins. In the present invention, a content of magnetic iron oxide fine particles is defined on the basis of the amount of magnetic iron oxide fine particles which are subjected to neither treatment with a coupling agent nor treatment with a substance having low softening point. When the content of magnetic iron oxide fine particles is less than 10 parts by mass, a developer provides a poor coloring power and it is difficult to suppress fogging. On the other hand, when the content exceeds 200 parts by mass, a holding power of the toner onto a developer bearing member due to a magnetic force strengthens to reduce developability and it becomes difficult to evenly disperse the magnetic iron oxide fine particles into the respective toner particles. Moreover, fixability may reduce.

The magnetic iron oxide fine particles are mainly composed of triiron tetraoxide and y-iron oxide, and may contain elements such as phosphorus, cobalt, nickel, copper, magnesium, manganese, aluminum, and silicon.

Those magnetic iron oxide fine particles have a BET specific surface area by a nitrogen adsorption method preferably in the range of 2 to 30 $m^2/g$, more preferably in the range of 3 to 28 $m^2/g$. The particles also have a Mohs hardness preferably in the range of 5 to 7.

Shapes of the magnetic iron oxide fine particles include an octahedral shape, a hexahedral shape, a spherical shape, a needle-like shape, and a scaly shape. However, shapes with low anisotropy such as an octahedral shape, a hexahedral shape, a spherical shape, and an amorphous shape are preferable for increasing an image density. The shapes of the magnetic iron oxide fine particles can be identified with, for example, an SEM. Preferable particle sizes of the magnetic iron oxide fine particles are as follows. In the particle size measurement where particles each having a particle diameter of 0.03 μm or more are considered, the volume average particle diameter is preferably in the range of 0.1 to 0.3 μm. In addition, particles each having a particle diameter in the range of 0.03 to 0.1 μm out of the magnetic iron oxide fine particles are preferably present in an amount of 40% by number or less.

It is generally unpreferable that the magnetic iron oxide fine particles have a volume average particle diameter of less than 0.1 μm. The reason for this is as follows. When an image is obtained by using a magnetic toner containing such magnetic iron oxide fine particles, the tint of the image shifts to a red tint, and the blackness of the image becomes insufficient. Alternatively, one tends to more strongly feel the red tint in a halftone image. In addition, the surface area of the magnetic iron oxide fine particles increases, so that the dispersibility of the particles reduces and the energy necessary for the manufacture increases. In other words, the manufacture cannot be performed efficiently. In addition, the effect of the magnetic iron oxide fine particles as a coloring agent weakens, so that the image density becomes unpreferably insufficient in some cases.

It is unpreferable that the magnetic iron oxide fine particles have a volume average particle diameter in excess of 0.3 μm. The reason for this is as follows. In the above case, the mass of one particle increases. As a result, a probability that the magnetic iron oxide fine particles are exposed to the toner surface owing to a difference in specific gravity between the particles and the binder resin at the time of manufacture increases. The possibility that the wear of a manufacturing apparatus becomes remarkable also increases. In addition, sedimentation stability of a dispersed product reduces.

When particles each having a particle diameter in the range of 0.03 to 0.1 μm out of the magnetic iron oxide fine particles are present in the toner in an amount in excess of 40% by number, the surface area of the magnetic iron oxide fine particles increases. Then, the dispersibility of the magnetic iron oxide fine particles in the toner particles reduces. As a result, the magnetic iron oxide fine particles easily cause an agglomerate in the toner particles, resulting in an increase in possibility that the chargeability of the toner is impaired or the coloring power of the toner is reduced. Therefore, particles each having a particle diameter in the range of 0.03 to 0.1 μm out of the magnetic iron oxide fine particles are preferably present in the toner in an amount of 40% by number or less. Particles each having a particle diameter in the range of 0.03 to 0.1 μm out of the magnetic iron oxide fine particles are more preferably present in the toner in an amount of 30% by number or less because the tendency for such a possibility to increase is mitigated.

Magnetic iron oxide fine particles each having a particle diameter of less than 0.03 μm receive a small stress at the time of toner manufacture because of their small particle diameters. Thus, the probability that the magnetic iron oxide fine particles are exposed to the toner particle surface reduces. Even if the particles are exposed to the toner particle surface, the particles pose substantially no problem because the particles very seldom act as leak sites. Therefore, the present invention focuses on particles each having a particle diameter of 0.03 μm or more, and defines the % by number of the particles.

In addition, in the present invention, particles each having a particle diameter of 0.3 μm or more out of the magnetic iron oxide fine particles are preferably present in an amount of 10% by number or less. When particles each having a particle diameter of 0.3 μm or more out of the magnetic iron oxide fine particles are present in an amount in excess of 10% by number, the coloring power of the toner tends to reduce and the image density also tends to reduce. In addition, even if the amount of the magnetic iron oxide fine particles used is maintained, the number of magnetic iron oxide fine particles reduces. Therefore, in terms of probability, it becomes difficult to: allow the magnetic iron oxide fine particles to be present in the vicinity of the toner particle surface; and allow each toner particle to contain a uniform number of magnetic iron oxide fine particles. The above case is not preferable. Particles each having a particle diameter of 0.3 μm or more out of the magnetic iron oxide fine particles are more preferably present in an amount of 5% by number or less.

In the present invention, in order that the magnetic iron oxide fine particles may satisfy the above conditions for particle size distribution, it is preferable to set the conditions for iron oxide manufacture and to use magnetic iron oxide fine particles which have been subjected to particle size distribution adjustments such as pulverization and classification. Examples of the means suitably used for classification include: means using centrifugation; means using sedimentation such as a thickener; and means such as a wet classification apparatus utilizing a cyclone.

The volume average particle diameter and particle size distribution of the magnetic iron oxide fine particles are determined according to the following measurement method.

Particles are sufficiently dispersed. In this state, the respective projected areas of 100 iron oxide particles in a field of view are measured in a photograph at a magnification of 30,000 obtained by using a transmission electron microscope (TEM). The equivalent diameter of a circle having an area equal to the projected area of each of the measured particles is defined as the particle diameter of the particle. The volume average particle diameter, the % by number of particles each having a particle diameter in the range of 0.03 to 0.1 μm, and the % by number of particles each having a particle diameter of 0.3 μm or more are calculated on the basis of the results. In the particle size measurement, particles each having a particle diameter of 0.03 μm or more are considered. The particle diameters can also be measured by using an image analyzer.

The volume average particle diameter and particle size distribution of the magnetic iron oxide fine particles in the toner particles are determined according to the following method.

After the toner to be observed has been sufficiently dispersed into an epoxy resin, the epoxy resin is cured in an atmosphere at a temperature of 40° C. over a 2-day period. The resultant cured product is turned into a flaky sample by means of a microtome. Then, the respective projected areas of 100 iron oxide particles in a field of view are measured in a photograph at a magnification of 10,000 to 40,000 obtained by using a transmission electron microscope (TEM). The equivalent diameter of a circle having an area equal to the projected area of each of the measured magnetic iron oxide fine particles is defined as the particle diameter of the particle. The volume average particle diameter, the % by number of particles each having a particle diameter in the range of 0.03 to 0.1 μm, and the % by number of particles each having a particle diameter of 0.3 μm or more are calculated on the basis of the results. The particle diameters can also be measured by using an image analyzer.

In the case where the toner of the present invention is manufactured according to the method involving direct polymerization in an aqueous medium, it is preferable that a polar compound be added to a polymerizable monomer composition as well as that the hydrophobic and magnetic iron oxide fine particles be used. The use of a trace amount of polar compound is particularly preferable in the present invention in terms of yield. This is because the use enables the state of presence of the magnetic iron oxide fine particles in the toner particles to be controlled and improves the stability of droplets during polymerization, thereby resulting in a sharp particle size distribution.

More specifically, a polar compound having a saponification value in the range of 20 to 200 is preferably used. Addition of such a polar compound to a system of direct polymerization in an aqueous medium facilitates the segregation of magnetic materials to the vicinity of the toner particle surface, the magnetic materials being evenly dispersed inside the droplets of the monomer composition that is granulated in the aqueous medium.

Examples of an available polar compound having a saponification value in the range of 20 to 200 in the present invention include all the resins each having a carboxylic acid derivative group (for instance, acrylic acid, methacrylic acid, or abietic acid) or a sulfur-based acid radical (for instance, sulfonic acid), and modified products of the resins. Specific examples of monomer components constituting such resins include: acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylates such as methyl methacrylate, ethyl methacrylate, n-butyl methacrylate, isobutyl methacrylate, n-propyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; maleic acid-based monomer components such as maleic anhydride and half maleate; compounds having sulfur-based acid radicals such as sulfonic acid; and abietic acid.

Of those compounds, a resin having a maleic acid component is particularly preferable. This is because a trace amount of the resin can exert effects. This is also because the resin does not impair the chargeability of the toner, and is excellent in compatibility with the binder resin. Specifically, a maleic anhydride copolymer represented by at least one of the following general formulae (1) and (2), and a ring-opened compound of the maleic anhydride copolymer are particularly preferable because the effects of the present invention are further exerted.

(1)

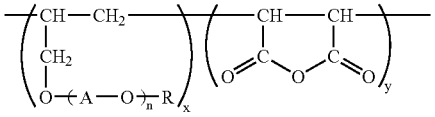

(2)

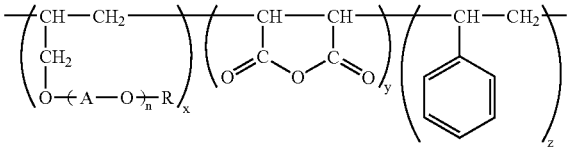

[In each formula, A represents an alkylene group, R represents a hydrogen atom or an alkyl group having 1 to 20 carbon atoms, n represents an integer of 1 to 20, and x, y, and z each represent a copolymerization ratio of each component.]

In the above general formula (1), x:y is preferably from 10:90 to 90:10 in molar ratio, more preferably from 20:80 to 80:20 in molar ratio.

In the above general formula (2), x:y is preferably from 10:90 to 90:10 in molar ratio, more preferably from 20:80 to 80:20 in molar ratio. (x+y): z is preferably from 50:50 to 99.9:0.1 in molar ratio, more preferably from 80:20 to 99.5:0.5 in molar ratio.

As described above, in the general formulae (1) and (2), each of x, y, and z is used for representing a copolymerization ratio of each constituent unit. The general formulae (1) and (2) represent not only a copolymer obtained by bonding a homopolymer in which x of first units are polymerized to a homopolymer in which y of second units are polymerized but also a copolymer in which the first to third units are copolymerized at random.

A polar compound content in the toner is preferably 0.001 to 10 parts by mass, more preferably 0.001 to 1.0 parts by mass, still more preferably 0.005 to 0.5 parts by mass with respect to 100 parts by mass of binder resins. A polar compound content of less than 0.001 part by mass provides no effect of polar compound addition. A polar compound content in excess of 10 parts by mass easily causes a reduction in absolute value of the charging amount as a result of charge leak, so that fogging and a reduction in durable image density easily occur.

Examples of a polymerizable monomer used in a polymerizable monomer composition constituting a binder resin in manufacturing a magnetic toner of the present invention include the following.

Examples of the polymerizable monomer include: styrene-based monomers such as styrene, o-methylstyrene, m-methylstyrene, p-methylstyrene, p-methoxystyrene, and p-ethylstyrene; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylonitrile; methacrylonitrile; and acrylamide.

Each of those polymerizable monomers can be used singly or two or more kinds of them can be used in combination. Of the above polymerizable monomers, styrene or a styrene derivative is preferably used singly or in combination with another polymerizable monomer in terms of the developing property and durability of the toner.

Furthermore, in the present invention, it is preferable that the toner further contains a releasing agent with a content of 1 to 50 parts by mass with respect to 100 parts by mass of binder resins. The presence of a releasing agent in the inner part of the capsule intermediate layer of magnetic iron oxide fine particles further improves fixability of the toner. A releasing agent content of less than 1 part by mass provides a small suppressing effect on low-temperature offset. A releasing agent content in excess of 50 parts by mass not only reduces the long-term storage stability of the toner but also deteriorates dispersibility of other toner materials in the toner particles, thereby leading to the deterioration of the flowability of the toner and a reduction in image property. In particular, when magnetic iron oxide fine particles the surface of which has been treated with a substance having low softening point are used, further excellent fixability can be obtained if the releasing agent content is in the preferable range described above.

Examples of a releasing agent that can be used in the toner of the present invention include such substances having low softening point as those listed above that can be used for treating the surface of the magnetic iron oxide fine particles. Of those, one having a top of an endothermic peak in the region of 30 to 100° C. in DSC measurement is preferable, and one having a top of an endothermic peak in the region of 35 to 90° C. is more preferable. The presence of an endothermic peak below 30° C. in DSC measurement causes wax components to exude even at room temperature, resulting in poor storage stability. The presence of an endothermic peak above 100° C. is not preferable because the fixation temperature increases and low-temperature offset easily occurs. Furthermore, when a toner is directly obtained according to a polymerization method in an aqueous medium, a releasing agent having a high endothermic temperature region is not preferable because the addition of a large amount of the releasing agent poses problems such as deposition of wax components during granulation.

The releasing agent preferably has a peak width at half height of the endothermic peak in DSC measurement of 10° C. or more. A releasing agent having a wide range of endothermic components from a low temperature to a high temperature can effectively express releasability over a wide temperature range while contributing to low-temperature fixation to a large extent.

The maximum endothermic peak temperature of wax components is measured in conformance with "ASTM D 3418-8". For example, a DSC-7 manufactured by Perkin-Elmer can be used for the measurement. The melting points of indium and zinc are used to correct the temperature of a detection portion of the apparatus, while the heat of melting of indium is used to correct a heat quantity. A pan made of aluminum is used as a measurement sample. An empty pan is set for reference. The measurement is performed at a rate of temperature increase of 10° C./min.

In the present invention, a resin as well as the polar compound described above may be added to the polymerizable monomer composition to perform polymerization. Suppose that one wishes to introduce, into a toner, a monomer component containing a hydrophilic functional group such as an amino group, a carboxylic group, a hydroxyl group, a sulfonic group, a glycidyl group, or a nitrile group. Such a monomer component cannot be used in monomer form because it is dissolved in an aqueous suspension because of its water-solubility to cause emulsion polymerization. The monomer component cannot be used until it is turned into: a copolymer with a vinyl compound (for instance, styrene) or ethylene such as a random copolymer, a block copolymer, or a graft copolymer; a polycondensate such as polyester or polyamide; or a polyaddition polymer such as polyether or polyimine. The coexsistence of such a high polymer containing a hydrophilic functional group in the toner causes phase separation of the wax components and further promotes incorporation into the toner. As a result, a toner excellent in offset resistance, blocking resistance, and low-temperature fixability can be obtained. The usage of the resin is preferably in the range of 1 to 20 parts by mass with respect to 100 parts by mass of the polymerizable monomers. A usage of less than 1 part by mass provides a small effect of addition while a usage in excess of 20 parts by mass complicates the design of various physical properties of the toner.

The high polymer containing a polar functional group preferably used has an average molecular weight of 3,000 or more. A polymer having a molecular weight of less than 3,000, especially 2,000 or lower, is not preferable because the polymer is easily concentrated in the vicinity of the toner particle surface to adversely affect the developability, the blocking resistance, and the like. In addition, when a polymer having a molecular weight different from the molecular weight range of a toner obtained by polymerizing a monomer is dissolved into the monomer for polymerization, a toner having a wide molecular weight distribution and a high offset resistance can be obtained.

The toner of the present invention may be compounded with a charge-controlling agent for stabilizing charging property. Although any conventionally known charge-controlling agent can be used, a charge-controlling agent that can provide a high charging speed and stably maintain a constant charging amount is preferable.

In the case where a toner is manufactured by means of the direct polymerization method, a charge-controlling agent which inhibits polymerization to a small extent and contains substantially no products soluble in an aqueous dispersion medium is particularly preferable. Such charge-controlling agents are specifically classified into a negative charge-controlling agent and a positive charge-controlling agent. Specific examples of the negative charge-controlling agent include: metal compounds of aromatic carboxylic acids such as salicylic acid, alkylsalicylic acid, dialkylsalicylic acid, naphthoic acid, and dicarboxylic acid; metal salts and metal complexes of azo dyes and azo pigments; polymer compounds each having a sulfonic group or a carboxylic group on its side chain; boron compounds; urea compounds; silicon compounds; and calixarene. Specific examples of the positive charge-controlling agent include: quaternary ammonium salts; polymer compounds having the quaternary ammonium salts on their side chains; guanidine compounds; nigrosine compounds; and imidazole compounds. Those charge-controlling agents are preferably used in an amount of 0.5 to 10 parts by mass with respect to 100 parts by mass of binder resins. However, the toner of the present invention does not always require the addition of a charge-controlling agent. The need for adding a charge-controlling agent can be eliminated by positively utilizing charging of the toner by friction with a layer-thickness regulating member or with a developer bearing member.

In the present invention, the magnetic iron oxide fine particles may also serve as coloring agents. Alternatively, other coloring agents except the magnetic iron oxide fine particles may be used in combination. Examples of coloring agents that can be used in combination include: magnetic and nonmagnetic inorganic compounds; and conventionally known dyes and pigments. Specific examples of such coloring agents include: ferromagnetic metal particles such as cobalt and nickel; alloys obtained by adding chromium, manganese, copper, zinc, aluminum, and rare earth elements to the ferromagnetic metal particles; hematite; titanium black; nigrosine dyes/pigments; carbon black; and phthalocyanine. The surface of each of those coloring agents may be treated before use.

When the toner of the present invention is manufactured according to the polymerization method, a polymerization initiator having a half life at the time of a polymerization reaction in the range of 0.5 to 30 hours is used in an addition amount of 0.5 to 20% by mass of the polymerizable monomers to perform the polymerization reaction. In this case, a polymer having a local maximum in the molecular weight range of 10,000 to 100,000 is obtained, so that a desirable strength and appropriate melting property can be imparted to the toner. Examples of the polymerization initiator include: azo-based and diazo-based polymerization initiators such as 2,2'-azobis-(2,4-dimethylvaleronitrile), 2,2'-azobisisobutyronitrile, 1,1'-azobis (cyclohexane-1-carbonitrile), 2,2'-azobis-4-methoxy-2,4-dimethylvaleronitrile, and azobisisobutyronitrile; and peroxide-based polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide.

In the present invention, a crosslinking agent may be added to the polymerizable monomer composition. A preferable addition amount is in the range of 0.001 to 15% by mass of the polymerizable monomer.

Next, toner manufacture according to a suspension polymerization method as an example of the direct polymerization methods is described. The suspension polymerization method involves: appropriately adding, to a polymerizable monomer constituting a binder resin, essential components for a toner such as a magnetic iron oxide fine particle, a polar compound having a saponification value in the range of 20 to 200 (or a monomer component constituting the polar compound), a coloring agent, a releasing agent, a plasticizer, a binder, a charge-controlling agent, and a crosslinking agent, and other additives such as an organic solvent for lowering the viscosity of a polymer produced by a polymerization method, and a dispersant; uniformly dissolving or dispersing the components and the additives into the polymerizable monomer by means of a disperser such as a homogenizer, a ball mill, a colloid mill, or an ultrasonic disperser; and suspending the resultant monomer system (polymerizable monomer composition) into an aqueous medium containing a dispersion stabilizer. At this time, it is recommended that a high-speed disperser such as a high-speed stirrer or an ultrasonic disperser be used to obtain a desired toner particle diameter in a stroke because the resultant toner particles have sharp particle sizes. A polymerization initiator may be added simultaneously with the addition of the other additives to the polymerizable monomer or may be mixed therewith immediately before the suspension into the aqueous medium. Alternatively, the polymerization initiator dissolved in the polymerizable monomer composition or in a solvent may be added immediately after the granulation and before the onset of the polymerization reaction.

After the granulation, it is sufficient that stirring be performed with an ordinary stirrer to such an extent that particle states are maintained and the floating and sedimentation of the particles are prevented. At this time, the polymerization of the polymerizable monomer is performed to produce toner particles. The pH of the aqueous medium before the addition of the monomer system provides a key to appropriately unevenly distribute the magnetic iron oxide fine particles to the vicinity of the toner particle surface by action of a polar compound. The pH is preferably in the range of 4 to 10.5 in order to obtain the toner of the present invention. When the pH is less than 4, the effect of the polar compound disappears nearly completely. Therefore, a large amount of polar compound must be added. In this case, a reduction in charging amount, broadening of a particle size distribution, and the like occur. When the pH exceeds 10.5, the addition of the polar compound facilitates the exposure of part of the magnetic iron oxide fine particles, thereby making it difficult to achieve the state of presence of the magnetic iron oxide fine particles of the present invention.

In the suspension polymerization method, any one of conventionally known surfactants and organic and inorganic dispersants can be used as the dispersion stabilizer. Of those, inorganic dispersants are preferably used. The reason for this is as follows. The inorganic dispersants hardly produce a harmful ultra-fine powder. In addition, the inorganic dispersants hardly lose their stability even if the reaction temperature is changed because they have dispersion stability by virtue of their steric hindrance. Further, the inorganic dispersants can be easily washed, therefore they hardly have detrimental effects on the toner. Examples of such inorganic dispersants include: polyvalent metal phosphates such as calcium phosphate, magnesium phosphate, aluminum phosphate, and zinc phosphate; carbonates such as calcium carbonate and magnesium carbonate; inorganic salts such as calcium metasilicate, calcium sulfate, and barium sulfate; inorganic hydroxides such as calcium hydroxide, magnesium hydroxide, and aluminum hydroxide; and inorganic oxides such as silica, bentonite, and alumina.

In the case where those inorganic dispersants are used, they may be used as they are. Alternatively, the inorganic dispersant particles can be produced in an aqueous medium in order to obtain finer particles. For example, in the case of calcium phosphate, an aqueous solution of sodium phosphate and an aqueous solution of calcium chloride can be mixed while being stirred at a high speed to produce water-insoluble calcium phosphate. As a result, more uniform and finer dispersion can be performed. At this time, a water-soluble sodium chloride salt is produced as a by-product. The presence of a water-soluble salt in the aqueous medium provides advantages because the water-soluble salt suppresses the dissolution of a polymerizable monomer in water, with the result that ultra-fine toner is hardly produced by emulsion polymerization. However, it is recommended that the aqueous medium be exchanged with another one or be subjected to desalting by means of an ion-exchange resin because the sodium chloride salt obstructs the removal of the residual polymerizable monomer at a final stage of the polymerization reaction. The inorganic dispersants can be nearly completely removed by dissolution with an acid or an alkali after the completion of the polymerization.

It is preferable that each of those inorganic dispersants be used singly or two or more kinds of them be used in combination in an amount of 0.2 to 20 parts by mass with respect to 100 parts by mass of the polymerizable monomers. 0.001 to 0.1 part by mass of surfactant may be used in combination to obtain such a finer toner as one having an average particle diameter of 5 μm or less.

Example of the surfactants include sodium dodecylbenzene sulfate, sodium tetradecyl sulfate, sodium pentadecyl sulfate, sodium octyl sulfate, sodium oleate, sodium laurate, sodium stearate, and potassium stearate.

It is preferable that the polymerization be performed by setting the polymerization temperature to 40° C. or more, generally 50 to 90° C. in the polymerization step. When the polymerization is performed in this temperature range, the releasing agent, the wax, and the like, which are to be sealed inside, precipitate owing to phase separation, so that incorporation becomes more complete one. The reaction temperature can be raised to fall within the range of 90 to 150° C. at a final stage of the polymerization reaction in order to consume the residual polymerizable monomer.

In addition, an inorganic fine powder serving as a flowability improver is preferably externally added to and mixed with the toner particles in the toner of the present invention. A hydrophobic and inorganic fine powder is particularly preferably added. Preferable examples of the inorganic fine powder include a titanium oxide fine powder, a silica fine powder, and an alumina fine powder. Of those, the silica fine powder is particularly preferably used.

The inorganic fine powder to be used in the toner of the present invention preferably has a specific surface area by nitrogen adsorption measured by a BET method of 30 $m^2/g$ or more, especially in the range of 50 to 400 $m^2/g$ because such a powder can provide good results.

Furthermore, the toner of the present invention may be added with an external additive other than the flowability improver as required.

For example, for the purpose of improving the cleanability of the toner and for other purposes, the toner particles are also preferably added with nearly spherical inorganic or organic fine particles each having a primary particle diameter in excess of 30 nm (preferably having a specific surface area of less than 50 $m^2/g$). The toner particles are more preferably added with nearly spherical inorganic or organic fine particles each having a primary particle diameter of 50 nm or more (preferably having a specific surface area of less than 30 $m^2/g$). Preferable examples of such fine particles include spherical silica particles, spherical polymethyl silsesquioxane particles, and spherical resin particles.

The toner particles may be also added with small amounts of other additives. Examples of the additives include: lubricant powders such as a polyethylene fluoride powder, a zinc stearate powder, and a polyvinylidene fluoride powder; abrasives such as a cerium oxide powder, a silicon carbide powder, and a strontium titanate powder; caking inhibitors; conductivity imparting agents such as a carbon black powder, a zinc oxide powder, and a tin oxide powder; and organic and inorganic fine particles opposite in polarity as developability improvers. The surface of those additives may also be subjected to a hydrophobic treatment before use.

It is recommended that the amount of such external additives as those described above be 0.1 to 5 parts by mass (preferably 0.1 to 3 parts by mass) with respect to 100 parts by mass of the toner particles.

In the case where the toner of the present invention is manufactured according to the pulverization method, any conventionally known method can be employed. For example, coated toner particles can be obtained according to the following method including multiple steps. The method includes the steps of: sufficiently mixing a binder resin, a coloring agent, a releasing agent, a charge-controlling agent, and, in some cases, part of magnetic iron oxide fine particles, and other additives such as a polar compound having a saponification value in the range of 20 to 200, and the like in a mixer such as a HENSCHEL MIXER or a ball mill; melting and kneading the mixture by using a heat kneader such as a heat roll, a kneader, or an extruder to disperse or dissolve the toner materials; solidifying the resultant through cooling; roughly pulverizing the solidified product; finely pulverizing the roughly pulverized product; classifying the finely pulverized product to obtain toner particles; and subjecting the resultant toner particles to a surface treatment with magnetic iron oxide fine particles and to a surface treatment with resin particles and the like to obtain coated toner particles. The resultant toner particles can be added and mixed with external additives such as a flowability improver and a resin particle as required to obtain a toner. The classification may be performed prior to or after the surface treatment. In the classification step, a multi-division classifier is preferably used in terms of production efficiency.

The pulverization step can be performed by using a conventionally known pulverizer such as a mechanical impact-type pulverizer or a jet-type pulverizer. It is sufficient that the pulverization be performed while heat is additionally applied or a mechanical impact force is accessorily applied in order to increase the toner circularity. A hot water bath method involving dispersing finely pulverized (classified as required) toner particles into hot water, a method involving passing such toner particles through a hot air current, and other methods are also available.

Examples of a method of applying a mechanical impact force include a method using a mechanical impact-type pulverizer such as a CRYPTRON SYSTEM manufactured by Kawasaki Heavy Industries, Ltd., or a TURBOMILL manufactured by Turbo Kogyo Co., Ltd. The examples also include a method involving: pressing a toner against the inside of a casing by means of a centrifugal force by using a blade rotating at a high speed; and applying a mechanical impact force to the toner by means of a compressive force, a frictional force, or the like. Examples of the apparatus that perform this method are a MECHANOFUSION SYSTEM manufactured by Hosokawa Micron Corp., or a HYBRIDIZATION SYSTEM manufactured by Nara Machinery Co., Ltd.

In the case where a mechanical impact force is applied, the ambient temperature at the time of the application is preferably set around the glass transition point Tg of the toner (that is, the ambient temperature is set at a temperature in the range of Tg±30° C.) in terms of agglomeration prevention and productivity. The application is more preferably performed at a temperature in the range of Tg±20° C. in order to increase transfer efficiency.

The toner of the present invention can also be manufactured according to: a method in which a molten mixture is atomized into the air by means of a disk or a multi-fluid nozzle to obtain spherical toner; a dispersion polymerization method in which an aqueous organic solvent in which a monomer is soluble and a polymer to be obtained is insoluble is used to directly produce toner; and an emulsion polymerization method typified by a soap free method in which direct polymerization is performed in the presence of a water-soluble polar polymerization initiator to manufacture toner; and other methods. In each manufacturing method, after manufacturing the toner particles, the toner particles can be subjected to a surface treatment with magnetic iron oxide fine particles and/or a resin as required.

Hereinafter, an example of an image forming apparatus that can suitably use the toner of the present invention will be described specifically with reference to the drawings.

Figure 2:
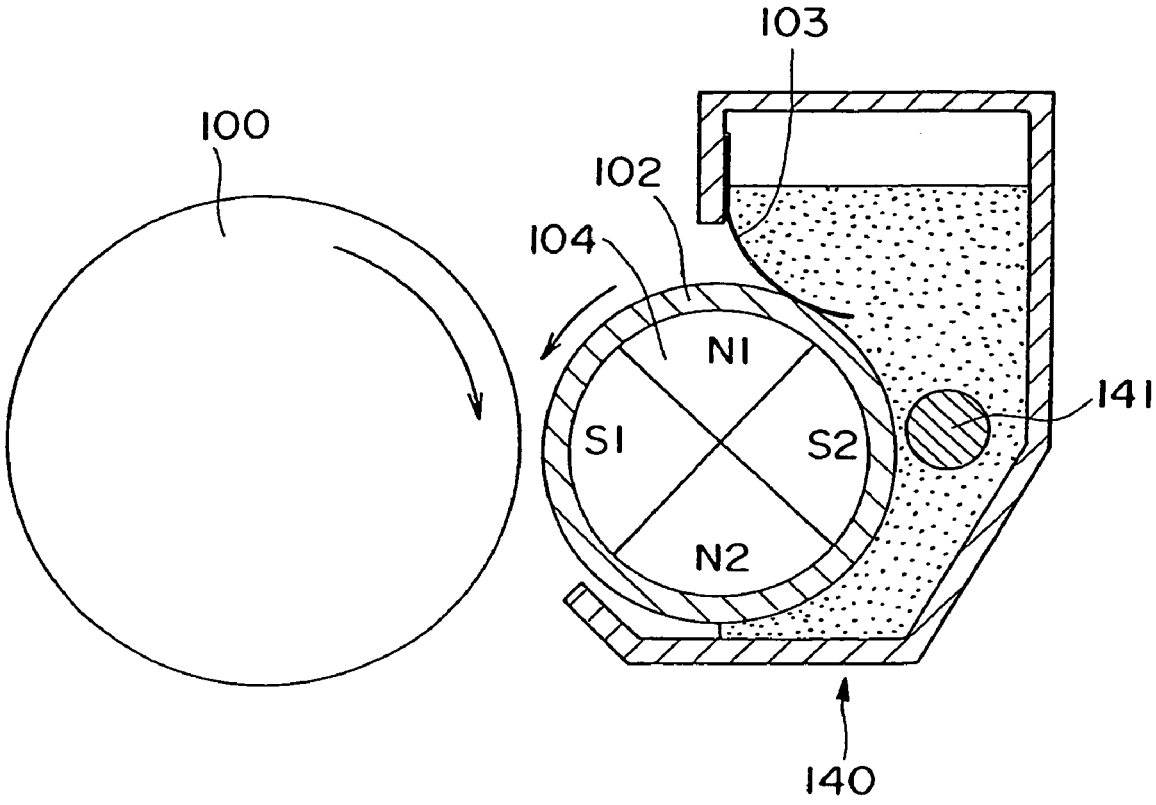
FIG. 2 is an enlarged view showing a configuration of a developing unit part in the image forming apparatus shown in FIG. 1.

FIG. 1 is a schematic sectional view showing the configuration of the image forming apparatus while FIG. 2 is a schematic sectional view showing the configuration of a developing unit of the image forming apparatus shown in FIG. 1. The image forming apparatus shown in FIG. 1 is an electrophotographic apparatus employing a developing method using a one-component magnetic toner. Reference numeral 100 denotes an electrostatic image bearing member (photosensitive drum). A primary charging roller 117, a developing unit 140, a transfer charging roller 114, a cleaner 116, a resister roller 124, and the like are arranged around the photosensitive drum 100. The photosensitive drum 100 is charged to, for example, −700 V by the primary charging roller 117 (an applied voltage is an alternating voltage of −2.0 kVpp and a direct voltage of −700 Vdc). Then, the photosensitive drum 100 is exposed by being irradiated with laser light 123 from a laser generating device 121. As a result, an electrostatic latent image corresponding to an image to be formed is formed on the photosensitive drum 100. The electrostatic latent image formed on the photosensitive drum 100 is developed with a one-component magnetic developer by the developing unit 140, and is transferred onto a transfer material by the transfer charging roller 114 that is brought into contact with the photosensitive member through the transfer material. The transfer material carrying the toner image is conveyed by a conveyor belt 125 to a fixing unit 126 that fixes the toner image on the transfer material. In addition, part of the toner remaining on the photosensitive drum 100 is cleaned by the cleaner 116.

As shown in FIG. 2, the developing unit 140 has, in proximity to the photosensitive drum 100, a cylindrical toner bearing member 102 (hereinafter, referred to as "developing sleeve") made of a nonmagnetic metal such as aluminum or stainless steel. A gap between the photosensitive drum 100 and the developing sleeve 102 is allowed to always have a predetermined distance (for example, about 300 μm) by a sleeve/photosensitive drum gap holding member (not shown) or the like. A magnet roller 104 is fixed and arranged in the developing sleeve 102 to be concentric with the developing sleeve. The developing sleeve 102 can rotate. As shown in the figure, the magnet roller 104 is provided with multiple magnetic poles. S1, N1, S2, and N2 affect the development, the regulation of a toner coating amount, the capture/feed of toner, and the prevention of toner blowout, respectively. The toner is applied to the developing sleeve 102 by a toner applying roller 141, and is fed while adhering to the sleeve. An elastic blade 103 is arranged as a member for regulating the amount of toner to be fed. The amount of toner to be fed to a development region is controlled by the pressure under which the elastic blade 103 is brought into contact with the developing sleeve 102. In the development region, direct and alternating developing biases are applied between the photosensitive drum 100 and the developing sleeve 102. Then, the toner on the developing sleeve flies onto the photosensitive drum 100 in correspondence with the electrostatic latent image to form a visible image.

Methods of measuring the respective physical properties in the present invention will be described in detail below.

(1) Ratio (B/A) of Iron Element Content (B) to Carbon Element Content (A) Present on Toner Surface A ratio (B/A) of an iron element content (B) to a carbon element content (A) present on the toner surface in the present invention is calculated by performing surface composition analysis based on ESCA (X-ray photoelectron spectroscopy).

In the present invention, the apparatus and measurement conditions of ESCA are as follows.

Apparatus used: 1600S-type X-ray photoelectron spectrometer manufactured by Physical Electronics Industries, Inc. (PHI)

Measurement conditions: X-ray source MgKα (400 W) Spectral region 800 μmϕ

In the present invention, the surface atomic percentage (atomic %) was calculated from the peak intensity of each of the measured elements by using a relative sensitivity factor provided by PHI.

Toner is used as a measurement sample. However, when an external additive is added to toner, a solvent that does not dissolve toner, such as isopropanol is used to wash the toner and to remove the external additive before the measurement is performed.

(2) Average Circularity of Toner

The circularity in the present invention is used as simple means for quantitatively representing a particle shape. In the present invention, particle shapes are measured by using a flow-type particle image analyzer FPIA-1000 manufactured by Sysmex Corporation, and the circularity is determined from the following expression (1). Furthermore, as shown in the following expression (2), a value obtained by dividing the sum of the circularities of all the particles measured by the number of the particles is defined as the average circularity.

$$\text{Circularity } (Ci) = \frac{\text{(Circumferential length of a circle having an area identical to that of a projected particle image)}}{\text{(Circumferential length of projected particle image)}} \quad (1)$$

$$\text{Average circularity } (C) = \sum_{i=1}^{m} Ci/m \quad (2)$$

The measurement apparatus "FPIA-1000" used in the present invention employs a calculation method involving: calculating the circularity of each particle; classifying the particles into 61 divisional ranges on the basis of their circularities, the divisional ranges being obtained by diving the circularity range of 0.40 to 1.00 at intervals of 0.01 (like 0.40 or more to less than 0.41, 0.41 or more to less than 0.42, . . . , 0.99 or more to less than 1.00, and 1.00; and calculating the average circularity by using the central value and frequency of a divisional range.

The error is very small between the value for the average circularity calculated by this method and the value for the average circularity calculated by using the above-described expressions directly using the circularities of the respective particles. The error is substantially negligible. Thus, the present invention uses such a calculation method obtained by modifying the concept of the expressions directly using the circularities of the respective particles for data processing-based purposes including: shortening of the time required for the calculation; and simplification of an operational expression used for the calculation.

The circularity in the present invention is an indication of the degree of irregularities on a particle. The circularity is 1.000 when a particle is of a complete spherical shape. The more complicated the surface shape, the lower the circularity.

A mode circularity is obtained as follows. Particles are classified into 61 divisional ranges on the basis of their circularities. The divisional ranges are obtained by diving the circularity range of 0.40 to 1.00 at intervals of 0.01 like 0.40 or more to less than 0.41, 0.41 or more to less than 0.42, . . . , 0.99 or more to less than 1.00, and 1.00. Then, the lower limit value of a divisional range having the maximum frequency is defined as the mode circularity.

A specific method of measuring the circularity includes: dispersing about 5 mg of toner into 10 ml of water containing about 0.1 mg of nonionic surfactant to prepare a dispersion; applying an ultrasonic wave (20 kHz, 50 W) to the dispersion for 5 minutes; and measuring the circularity distribution of the particles each having a circle equivalent diameter of 3 μm or more using the above flow-type particle image analyzer while adjusting the dispersion concentration to 5,000 to 20,000 particles/μl.

The outline of the circularity measurement, which is described in each of the catalog of FPIA-1000 published by Sysmex Corporation, the operation manual of the measurement apparatus, and JP 08-136439 A, is as follows.

A sample dispersion is allowed to pass through a flow path (expanding along the flow direction) of a flat, oblate, and transparent flow cell (having a thickness of about 200 μm). A stroboscope and a CCD camera are mounted on both sides with respect to the flow cell in such a manner that an optical path intersecting the thickness of the flow cell is formed. While the sample dispersion is flowing, stroboscope light is applied at an interval of 1/30 second in order to obtain the image of a particle flowing through the flow cell. As a result, each particle is taken as a two-dimensional image having a constant range in parallel with the flow cell. The diameter of a circle having an area equal to that of the two-dimensional image of each particle is calculated as a circle equivalent diameter. The circularity of each particle is calculated from the above expression for calculating the circularity by using the projected area of the two-dimensional image of each particle and the circumferential length of the projected image.

(3) Particle Size Distribution of Toner

COULTER COUNTER TA-II (manufactured by Beckman Coulter) is used as a measurement apparatus. An interface (manufactured by Nikkaki-bios) and a CX-1 personal computer (manufactured by Canon Inc.) are connected to the measurement apparatus to output a number distribution and a volume distribution. An 1% aqueous solution of NaCl prepared by using extra-pure sodium chloride is used as an electrolyte. For example, an ISOTON R-II (available from Coulter Scientific Japan) can be used as the electrolyte. The measurement method is as follows. 0.1 to 5 ml of surfactant as a dispersant (preferably alkylbenzene sulfonate) is added to 100 to 150 ml of the electrolyte. Furthermore, 2 to 20 mg of measurement sample is added to the mixture. The electrolyte in which the sample is suspended is subjected to a dispersion treatment for about 1 to 3 minutes by means of an ultrasonic disperser. The volume and number of toner particles are measured with the COULTER COUNTER TA-II by using a 100 μm aperture as an aperture to calculate the volume distribution and number distribution of particles each having a particle diameter in the range of 2 to 40 μm. The number average particle diameter Dl and the weight average particle diameter D4 are determined from the distributions (the central value of each channel is defined as the representative value of the channel).

(4) D/C and Distribution of Magnetic Iron Oxide Fine Particles

In the present invention, a preferable method of measuring a specific D/C or distribution of magnetic iron oxide fine particles with a TEM is as follows. Particles to be observed are sufficiently dispersed into a room temperature-curing epoxy resin. After that, the resultant is allowed to cure in an atmosphere at a temperature of 40° C. over a 2-day period to obtain a cured product. The cured product is directly turned into a flaky sample by means of a microtome provided with a diamond tooth before the observation. Alternatively, the cured product is frozen and turned into a flaky sample in the same way before the observation.

A specific method of determining the ratio of particles concerned is as follows. The circle equivalent diameters of particles for determining a ratio D/C with a TEM (the circle equivalent diameters are defined as projected area diameters C) are determined from the cross sectional area of toner obtained from a micrograph. Particles each having a projected area diameter in the range of the number average particle diameter determined by the above method ±10% are regarded as target particles. The minimum value (D) for a distance between a magnetic iron oxide fine particle and the toner particle surface is measured for 100 particles of the target particles. Then, the ratio D/C is determined. Subsequently, the ratio of particles each having a ratio D/C of 0.02 or less is calculated.

The distribution of magnetic iron oxide fine particles is obtained by counting the number of magnetic iron oxide fine particles in the target particles and the number of magnetic iron oxide fine particles outside a depth 0.2 time as far as the projected area diameter from the toner particle surface. At this time, the micrograph preferably has a magnification in the range of 10,000 to 20,000 in order to perform precise measurement. In the present invention, the observation and measurement are performed on a transmission electron microscope (H-600, manufactured by Hitachi) at an acceleration voltage of 100 kV and using a micrograph at a magnification of 10,000.

(5) Saponification Value

A saponification value is determined as follows. A basic operation for the determination is in conformance with JIS-K0070.

(i) Reagent (a) Solvent: An ethyl ether-ethyl alcohol mixed solution (1+1 or 2+1) or a benzene-ethyl alcohol mixed solution (1+1 or 2+1) is used. Each of those mixed solutions is neutralized with a 0.1-mol/l solution of potassium hydroxide in ethyl alcohol using phenolphthalein as an indicator immediately before the use of the mixed solution.

(b) Phenolphthalein solution: 1 g of phenolphthalein is dissolved into 100 ml of ethyl alcohol (95 v/v %).

(c) 0.1-mol/l potassium hydroxide-ethyl alcohol solution: 7.0 g of potassium hydroxide are dissolved in as small an amount of water, and ethyl alcohol (95 v/v %) is added to the solution to have a total volume of 1 l. Then, the resultant is allowed to leave for 2 to 3 days, followed by filtration. Standardization is performed in conformance with JIS K 8006 (basic items concerning titration during reagent content test).

(ii) Operation: 1 to 20 g of sample are precisely weighted. 100 ml of solvent and several drops of phenolphthalein solution as an indicator are added to the sample, and the mixture is sufficiently shaken until the sample is completely dissolved. When the sample is a solid sample, the sample is dissolved while being heated in a water bath. After the mixture has been cooled, an excessive amount, specifically 100 to 200 ml, of 0.1-mol/l potassium hydroxide-ethyl alcohol solution are added to the mixture, and the whole is refluxed under heating for 1 hour, saponified, and then cooled. The resultant solution is subjected to back titration with a 0.1-mol/l aqueous solution of hydrochloric acid. The amount of the aqueous solution of hydrochloric acid at which the pale red color of the indicator disappears for consecutive 30 seconds is defined as the end point of the titration. A blank test is performed in tandem with this test.

(iii) Calculation Expression: The Saponification Value is Calculated from the Following Expression.

$$A=(B-C)\times 5.611\times f/S$$

A: the saponification value (mgKOH/g)

B: the amount of the 0.1-mol/l aqueous solution of hydrochloric acid added in the blank test C: the amount of the 0.1-mol/l aqueous solution of hydrochloric acid added in this test f: the factor of the 0.1-mol/l aqueous solution of hydrochloric acid S: mass of the sample (g)

Hereinafter, the present invention will be described more specifically by way of manufacturing examples and examples. However, the present invention is not limited to these examples. The term "part" in any one of the following prescriptions means "part by mass".

Manufacture of Magnetic Iron Oxide Fine Particles 1

1.0 to 1.1 equivalents of caustic soda solution with respect to iron ions were mixed with an aqueous solution of ferrous sulfate to prepare an aqueous solution containing ferrous hydroxide. Air was blown into the aqueous solution while the pH of the aqueous solution was maintained at 9, to perform an oxidation reaction in the temperature range of 80 to 90° C. As a result, a slurry liquid for producing a seed crystal was prepared.

Subsequently, 0.9 to 1.2 equivalents of aqueous solution of ferrous sulfate with respect to the original alkali amount (the sodium component of the caustic soda) were added to the slurry liquid. After that, air was blown into the slurry liquid while the pH of the slurry liquid was maintained at 8, to thereby allow an oxidation reaction to proceed. At a final stage of the oxidation reaction, the pH of the slurry liquid was adjusted to about 6, and 0.6 part of silane coupling agent [n-$C_4H_9Si(OCH_3)_3$] with respect to 100 parts of magnetic iron oxide was added to the slurry liquid, and the whole was sufficiently stirred. The produced hydrophobic iron oxide particles were washed, filtrated, and dried according to an ordinary method. Then, agglomerate particles were crushed to obtain magnetic iron oxide fine particles 1.

Manufacture of Magnetic Iron Oxide Fine Particles 2

1.0 to 1.1 equivalents of caustic soda solution with respect to iron ions were mixed with an aqueous solution of ferrous sulfate to prepare an aqueous solution containing ferrous hydroxide. Air was blown into the aqueous solution while the pH of the aqueous solution was maintained at 9, to perform an oxidation reaction in the temperature range of 80 to 90° C. As a result, a slurry liquid for producing a seed crystal was prepared.

Subsequently, 0.9 to 1.2 equivalents of aqueous solution of ferrous sulfate with respect to the original alkali amount (the sodium component of the caustic soda) were added to the slurry liquid. After that, air was blown into the slurry liquid while the pH of the slurry liquid was maintained at 8, to thereby allow an oxidation reaction to proceed. At a final stage of the oxidation reaction, the pH of the slurry liquid was adjusted to complete the oxidation reaction. The produced particles were washed, filtrated, and dried according to an ordinary method. Then, agglomerate particles were crushed to obtain iron oxide particles. The resultant iron oxide particles were subjected to a hydrophobic treatment with a silane coupling agent [n-$C_4H_9Si(OCH_3)_3$] diluted with methanol by a dilution factor of 10 (this solution was prepared in such a manner that the amount of coupling agent would be 0.6 part with respect to 100 parts of magnetic iron oxide) in a gas phase to obtain magnetic iron oxide fine particles 2.

Manufacture of Magnetic Iron Oxide Fine Particles 3

1.0 to 1.1 equivalents of caustic soda solution with respect to iron ions were mixed with an aqueous solution of ferrous sulfate to prepare an aqueous solution containing ferrous hydroxide. Air was blown into the aqueous solution while the pH of the aqueous solution was maintained at 9, to perform an oxidation reaction in the temperature range of 80 to 90° C. As a result, a slurry liquid for producing a seed crystal was prepared.

Subsequently, 0.9 to 1.2 equivalents of aqueous solution of ferrous sulfate with respect to the original alkali amount (the sodium component of the caustic soda) were added to the slurry liquid. After that, air was blown into the slurry liquid while the pH of the slurry liquid was maintained at 8, to thereby allow an oxidation reaction to proceed. At a final stage of the oxidation reaction, the pH of the slurry liquid was adjusted to complete the oxidation reaction. The produced particles were washed, filtrated, and dried according to an ordinary method. Then, agglomerate particles were crushed to obtain magnetic iron oxide fine particles 3.

Manufacture of Magnetic Iron Oxide Fine Particle 4

An aqueous solution of ferrous sulfate was mixed with 1.0 to 1.1 equivalents of caustic soda solution with respect to iron ions, 1.5% by mass of sodium hexametaphosphate in terms of phosphorous element with respect to iron elements, and 1.5% by mass of sodium silicate in terms of silicon element with respect to iron elements, to prepare an aqueous solution containing ferrous hydroxide.

Air was blown into the aqueous solution while the pH of the aqueous solution was maintained at 9, to perform an oxidation reaction in the temperature range of 80 to 90° C. As a result, a slurry liquid for producing a seed crystal was prepared. Then, 0.9 to 1.2 equivalents of aqueous solution of ferrous sulfate with respect to the original alkali amount (the sodium component of the caustic soda) were added to the slurry liquid. After that, air was blown into the slurry liquid while the pH of the slurry liquid was maintained at 8, to thereby allow an oxidation reaction to proceed. As a result, a slurry liquid containing magnetic iron oxide was prepared. The slurry liquid was washed, filtrated, and dried, and the dried product was crushed. The crushed product was added with 2 parts of n-octyltriethoxysilane coupling agent with respect to 100 parts of magnetic iron oxide. The mixture was treated in a wheel-type kneader for 60 minutes. Then, the magnetic iron oxide surface was subjected to a hydrophobic treatment.

100 parts of magnetic iron oxide thus obtained were added with 5 parts of Fischer-Tropsch wax (the volume average particle diameter had been adjusted to 30 μm) (Mn=750, DSC endothermic peak temperature=125° C.). The mixture was treated in a wheel-type kneader for 2 hours while being pressurized, to thereby obtain magnetic iron oxide fine particles 4 having a volume average particle diameter of 0.22 μm the surface of which had been treated with a wax to be in a nearly uniform state.

Manufacture of Magnetic Iron Oxide Fine Particles 5

Magnetic iron oxide fine particles 5 were obtained in the same manner as in "Manufacture of magnetic iron oxide fine particles 4" except that the Fischer-Tropsch wax was changed to a polypropylene wax (the volume average particle diameter had been adjusted to 130 μm; Mn=960, DSC endothermic peak temperature=154° C.)

Manufacture of Magnetic Iron Oxide Fine Particles 6

Magnetic iron oxide fine particles 6 were obtained in the same manner as in "Manufacture of magnetic iron oxide fine particles 4" except that the Fischer-Tropsch wax was changed to a paraffin wax (the volume average particle diameter had been adjusted to 60 μm; Mn=430, DSC endothermic peak temperature=78° C.)

Manufacture of Magnetic Iron Oxide Fine Particles 7

Magnetic iron oxide fine particles 7 were obtained in the same manner as in "Manufacture of magnetic iron oxide fine particles 4" except that the amount of Fischer-Tropsch wax was changed from 5 parts to 0.2 part.

Manufacture of Magnetic Iron Oxide Fine Particles 8

Magnetic iron oxide fine particles 8 were obtained in the same manner as in "Manufacture of magnetic iron oxide fine particles 4" except that the amount of Fischer-Tropsch wax was changed from 5 parts to 16 parts.

Manufacture of Magnetic Iron Oxide Fine Particles 9

An oxidation reaction was allowed to proceed in the same manner as in "Manufacture of magnetic iron oxide fine particles 4" to obtain a slurry liquid containing magnetic iron oxide. The slurry liquid was filtrated, washed, and dried. Then, the dried product was sufficiently crushed. The crushed product was added with 2 parts of n-octyltriethoxysilane coupling agent with respect to 100 parts of magnetic iron oxide. The mixture was treated in a wheel-type kneader for 60 minutes to obtain magnetic iron oxide fine particles 9.

Manufacture of Magnetic Iron Oxide Fine Particles 10

An oxidation reaction was allowed to proceed in the same manner as in "Manufacture of magnetic iron oxide fine particles 4" to obtain a slurry liquid containing magnetic iron oxide. The slurry liquid was filtrated, washed, and dried. Then, the dried product was sufficiently crushed. The crushed product was added with 5 parts of Fischer-Tropsch wax (the volume average particle diameter had been adjusted to 30 μm; Mn=520, DSC endothermic peak temperature=78° C.) with respect to 100 parts of magnetic iron oxide. The mixture was treated in a wheel-type kneader for 2 hours to obtain magnetic iron oxide fine particles 10.

Table 1 shows the physical properties of the magnetic iron oxide fine particles 1 to 10.

TABLE 1

Treatment of magnetic iron oxide fine particles and the physical properties thereof

| Magnetic iron oxide fine particles No. | Coupling agent: Kind | Coupling agent: Amount used for treatment (Part by mass) | Coupling agent: Treatment method | substance having low softening point: Kind | substance having low softening point: Amount used for treatment (Part by mass) | Volume average particle diameter (μm) | Saturation magnetization in a magnetic field of 79.6 kA/m ($Am^2/kg$) |
|---|---|---|---|---|---|---|---|
| 1 | n-butyltrimethoxysilane | 0.6 | Wet | — | — | 0.20 | 67.9 |
| 2 | n-butyltrimethoxysilane | 0.6 | Dry | — | — | 0.20 | 68.0 |
| 3 | — | — | — | — | — | 0.20 | 68.3 |
| 4 | n-octyltriethoxysilane | 2 | Dry | Fischer-Tropsch wax | 5 | 0.22 | 64.8 |
| 5 | n-octyltriethoxysilane | 2 | Dry | Polypropylene wax | 5 | 0.22 | 64.9 |
| 6 | n-octyltriethoxysilane | 2 | Dry | Paraffin wax | 5 | 0.22 | 64.7 |
| 7 | n-octyltriethoxysilane | 2 | Dry | Fischer-Tropsch wax | 0.2 | 0.20 | 67.9 |
| 8 | n-octyltriethoxysilane | 2 | Dry | Fischer-Tropsch wax | 16 | 0.25 | 58.9 |
| 9 | n-octyltriethoxysilane | 2 | Dry | — | — | 0.20 | 68.0 |
| 10 | — | — | — | Fischer-Tropsch wax | 5 | 0.22 | 65.1 |

Manufacture of Magnetic Toner A 451 parts by mass of 0.1-mol/l aqueous solution of $Na_3PO_4$ were added to 709 parts by mass of ion-exchanged water, and the mixture was heated to 60° C. Then, 67.7 parts by mass of 1.0-mol/l aqueous solution of $CaCl_2$ were gradually added to the mixture to obtain an aqueous medium containing $Ca_3(PO_4)_2$ and having a pH of 8.5.

In the meantime, the following prescriptions were uniformly dispersed and mixed by using an ATLITER (manufactured by Mitsui Miike Machinery Co., Ltd.).

| | |
|---|---|
| Styrene | 78 parts |
| n-butylacrylate | 22 parts |
| Saturated polyester resin (polycondensate of propylene oxide modified bisphenol A and isophthalic acid; acid value = 8 mgKOH/g, Mn = 6,000, Mw = 10,000, Tg = 65° C.) | 5 parts |
| Negative charge-controlling agent (T-77; monoazo dye-based Fe compound (available from Hodogaya Chemical Co., Ltd.)) | 2 parts |
| Magnetic iron oxide fine particles 1 (containing 0.48 part of coupling agent) | 80 parts |
| Polar compound (1) (compound represented by above general formula (2), wherein n = 9, A = —$CH_2CH_2$—, R = methyl, and x:y:z = 50:40:10; saponification value = 150, peak molecular weight (Mp) = 3,000) | 0.1 part |

After the monomer composition had been heated to 60° C., 15 parts of ester wax (behenyl behenate; DSC endothermic main peak=70° C.) were mixed with and dissolved into the monomer composition. 2 parts by mass of butyl peroxide serving as a polymerization initiator were dissolved into the resultant composition to obtain a polymerizable monomer composition.

The polymerizable monomer composition was added to the aqueous medium, and the mixture was stirred by using a TK HOMOMIXER (manufactured by Tokushu Kika Kogyo Co., Ltd.) at 10,000 rpm for 15 minutes under a $N_2$ atmosphere at 60° C., followed by granulation. After that, the granulated product was allowed to react at 80° C. for 1 hour while being stuffed with a paddle stirring blade. Then, the granulated product was stuffed for an additional 10 hours with the liquid temperature kept at 80° C. After the completion of the reaction, the suspension was cooled, and hydrochloric acid was added to the suspension to dissolve $Ca_3(P_{04})_2$. The resultant was filtrated, washed with water, and dried to obtain toner particles.

100 parts of the toner particles and 1.4 parts of hydrophobic silica fine powder having a BET specific surface area after the treatments with hexamethyldisilazane and then with silicone oil of 120 $m^2/g$ were mixed in a HENSCHEL mixer (manufactured by Mitsui Miike Machinery Co., Ltd.) to prepare a magnetic toner A (having a weight average particle diameter of 5.4 μm). Table 2 shows the physical properties of the magnetic toner A.

Manufacture of Magnetic Toner B

A magnetic toner B was obtained in the same manner as in "Manufacture of magnetic toner A" except that the addition amount of the polar compound (1) was changed to 0.05 part. Table 2 shows the physical properties of the magnetic toner B.

Manufacture of Magnetic Toner C

A magnetic toner C was obtained in the same manner as in "Manufacture of magnetic toner A" except that the addition amount of the polar compound (1) was changed to 1.0 part. Table 2 shows the physical properties of the magnetic toner C.

Manufacture of Magnetic Toner D 3 parts of emulsion particles (styrene-methacrylic acid, Mn=6,800, Mw=32,000, particle diameter 0.05 μm) were externally added to 100 parts of the toner particles obtained in "Manufacture of magnetic toner A". After that, fixing and coating of the emulsion particles were repeatedly performed by using an impact-type surface treatment apparatus (treatment temperature=50° C., circumferential speed of rotary treatment blade=90 m/sec) to obtain coated toner particles. 1.4 parts of hydrophobic silica fine powder were externally added to 100 parts of the coated toner particles in the same manner as in "Manufacture of magnetic toner A" to obtain a magnetic toner D. Table 2 shows the physical properties of the magnetic toner D.

Manufacture of Magnetic Toner E

A magnetic toner E was obtained in the same manner as in "Manufacture of magnetic toner A" except that the polar compound (1) (0.1 part) was changed to 0.08 part of polar compound (2) (styrene-methacrylic acid copolymer (styrene:methacrylic acid=75:25); saponification value=130, Mp=6,000). Table 2 shows the physical properties of the magnetic toner E.

Manufacture of Magnetic Toner F

A magnetic toner F was obtained in the same manner as in "Manufacture of magnetic toner A" except that the polar compound (1) (0.1 part) was changed to 5.0 parts of polar compound (3) (styrene-methacrylic acid copolymer (styrene:methacrylic acid=95:5); saponification value=18, Mp=6,200). Table 2 shows the physical properties of the magnetic toner F.

Manufacture of Magnetic Toner G

A magnetic toner G was obtained in the same manner as in "Manufacture of magnetic toner A" except that the polar compound (1) (0.1 part) was changed to 12 parts of polar compound (4) (styrene-n-butylacrylate-maleic anhydride copolymer (styrene:n-butylacrylate:maleic anhydride=87:10:3); saponification value=130, Mp=6,000). Table 2 shows the physical properties of the magnetic toner G.

Manufacture of Magnetic Toner H

A magnetic toner H was obtained in the same manner as in "Manufacture of magnetic toner A" except that the magnetic iron oxide fine particles 1 was changed to the magnetic iron oxide fine particles 2. Table 2 shows the physical properties of the magnetic toner H.

| Manufacture of magnetic toner I | |
|---|---|
| Styrene/n-butylacrylate copolymer (78/22 in mass ratio; Mn = 24,300, Mw/Mn = 3.0) | 100 parts |
| Saturated polyester resin (polycondensate of propylene oxide modified bisphenol A and isophthalic acid; acid value = 8 mgKOH/g, Mn = 6,000, Mw = 10,000, Tg = 65° C.) | 5 parts |
| Negative charge-controlling agent (T-77; monoazo dye-based Fe compound (available from Hodogaya Chemical Co., Ltd.)) | 2 parts |
| Magnetic iron oxide fine particles 1 (containing 0.12 part of coupling agent) | 20 parts |
| Polar compound (1) as above described | 0.1 part |
| Ester wax used for manufacture of magnetic toner A | 5 parts |

The above materials were mixed in a blender, and the mixture was melt and kneaded in a biaxial extruder heated to 110° C. After the kneaded product had been cooled, the cooled kneaded product was roughly pulverized with a hammer mill. The roughly pulverized product was finely pulverized with a TURBOMILL (manufactured by Turbo Kogyo Co., Ltd.). The finely pulverized product was subjected to air classification to obtain toner particles having a weight average particle diameter of 6.0 μm. After that, 60 parts of the magnetic iron oxide fine particles 1 (containing 0.36 part of coupling agent) were externally added to 132.1 parts of the toner particles. The magnetic iron oxide fine particles 1 was fixed to the toner particle surface by using an impact-type surface treatment apparatus (treatment temperature 55° C., rotary treatment blade circumferential speed 90 m/sec) to obtain magnetic material-fixed toner particles.

Furthermore, 8 parts of emulsion particles (styrene-methacrylic acid, Mn=6,800, Mw=32,000, particle diameter 0.05 μm) were externally added to 100 parts of the magnetic material-fixed toner particles. After that, fixing and coating of the emulsion particles were performed by using an impact-type surface treatment apparatus (treatment temperature=50° C., circumferential speed of rotary treatment blade=90 m/sec) to obtain coated toner particles. 1.4 parts of hydrophobic silica fine powder were externally added to 100 parts of the coated toner particles in the same manner as in "Manufacture of magnetic toner A" to obtain a magnetic toner I. Table 2 shows the physical properties of the magnetic toner I.

Manufacture of Magnetic Toner J

A magnetic toner J was obtained in the same manner as in "Manufacture of magnetic toner I" except that the magnetic iron oxide fine particles to be fixed to the toner particle surface were changed from the magnetic iron oxide fine particles 1 to the magnetic iron oxide fine particles 3. Table 2 shows the physical properties of the magnetic toner J.

| Manufacture of magnetic toner K | |
|---|---|
| Styrene/n-butylacrylate copolymer (78/22 in mass ratio; Mn = 24,300, Mw/Mn = 3.0) | 100 parts |
| Saturated polyester resin (polycondensate of propylene oxide modified bisphenol A and isophthalic acid; acid value = 8 mgKOH/g, Mn = 6,000, Mw = 10,000, Tg = 65° C.) | 5 parts |
| Negative charge-controlling agent (T-77; monoazo dye-based Fe compound (available from Hodogaya Chemical Co., Ltd.)) | 2 parts |
| Magnetic iron oxide fine particles 1 (containing 0.48 part of coupling agent) | 80 parts |
| Polar compound (1) as above described | 0.1 part |
| Ester wax used for manufacture of magnetic toner A | 5 parts |

The above materials were mixed in a blender, and the mixture was melt and kneaded in a biaxial extruder heated to 110° C. After the kneaded product had been cooled, the cooled kneaded product was roughly pulverized with a hammer mill. The roughly pulverized product was finely pulverized with a TURBOMILL (manufactured by Turbo Kogyo Co., Ltd.). The finely pulverized product was subjected to air classification to obtain toner particles having a weight average particle diameter of 6.5 μm. 1.4 parts of hydrophobic silica fine powder were externally added to 100 parts of the toner particles in the same manner as in "Manufacture of magnetic toner A" to obtain a magnetic toner K. Table 2 shows the physical properties of the magnetic toner K.

Manufacture of Magnetic Toner L 30 parts of emulsion particles (styrene-methacrylic acid, Mn=6,800, Mw=32,000, particle diameter 0.05 μm) were externally added to 100 parts of the toner particles obtained in "Manufacture of magnetic toner A". After that, fixing and coating of the emulsion particles were repeatedly performed by using an impact-type surface treatment apparatus (treatment temperature=50° C., circumferential speed of rotary treatment blade=90 m/sec) to obtain coated toner particles. 1.4 parts of hydrophobic silica fine powder were externally added to 100 parts of the coated toner particles in the same manner as in "Manufacture of magnetic toner A" to obtain a magnetic toner L. Table 2 shows the physical properties of the magnetic toner L.

Manufacture of Magnetic Toner M

Toner particles were obtained in the same manner as in "Manufacture of magnetic toner A" except that no magnetic iron oxide fine particles 1 were used in the prescriptions for manufacturing the magnetic toner A. 40 parts of the magnetic iron oxide fine particles 3 were externally added to 121 parts of the toner particles. The magnetic iron oxide fine particles were fixed to the surface of the toner particle by using an impact-type surface treatment apparatus (treatment temperature=55° C., circumferential speed of rotary treatment blade=90 m/sec) to obtain magnetic material-fixed toner particles. Furthermore, 20 parts of emulsion particles (styrene-methacrylic acid, particle diameter 0.05 μm) and 40 parts of the magnetic iron oxide fine particles 3 were externally added to 140 parts of the magnetic material-fixed toner particles. After that, fixing and coating of the emulsion particles and of the magnetic iron oxide fine particles 3 were performed by using an impact-type surface treatment apparatus (treatment temperature=50° C., circumferential speed of rotary treatment blade=90 m/sec) to obtain coated toner particles. 1.4 parts of hydrophobic silica fine powder were externally added to 100 parts of the coated toner particles in the same manner as in "Manufacture of magnetic toner A" to obtain a magnetic toner M (weight average particle diameter 7.1 μm). Table 2 shows the physical properties of the magnetic toner M.

Manufacture of Magnetic Toner N

A magnetic toner N was obtained in the same manner as in "Manufacture of magnetic toner A" except that the polar compound (1) was not used. Table 2 shows the physical properties of the magnetic toner N.

TABLE 2

Physical properties of magnetic toners

| | Prescriptions | | | | | | | Physical properties | | | | | |
|---|---|---|---|---|---|---|---|---|---|---|---|---|---|
| | Magnetic iron oxide fine particles | | Polar compound | | | Wax | | | | | | | |
| Magnetic toner No. | Kind | Addition amount (part) | Kind | Saponification value (mgKOH/g) | Addition amount (part) | Endothermic peak (° C.) | Addition amount (part) | B/A | Ratio 1(*1) | Ratio 2(*2) | Weight average particle diameter (μm) | Average circularity | Mode circularity |
| A | 1 | 80 | 1 | 150 | 0.1 | 70 | 15 | 0.0002 | 80 | 80 | 5.4 | 0.998 | 1.00 |
| B | 1 | 80 | 1 | 150 | 0.05 | 70 | 15 | 0.0004 | 76 | 56 | 5.6 | 0.997 | 0.99 |
| C | 1 | 80 | 1 | 150 | 1 | 70 | 15 | 0.0009 | 90 | 92 | 5.8 | 0.980 | 1.00 |
| D | 1 | 80 | 1 | 150 | 0.1 | 70 | 15 | 0.0001 | 65 | 70 | 6.2 | 0.997 | 0.99 |
| E | 1 | 80 | 2 | 130 | 0.08 | 70 | 15 | 0.0004 | 82 | 61 | 6.0 | 0.986 | 0.99 |
| F | 1 | 80 | 3 | 18 | 5 | 70 | 15 | 0.0005 | 86 | 61 | 6.5 | 0.976 | 0.99 |
| G | 1 | 80 | 4 | 80 | 12 | 70 | 15 | 0.0007 | 87 | 85 | 6.6 | 0.973 | 0.99 |
| H | 2 | 80 | 1 | 150 | 0.1 | 70 | 15 | 0.0003 | 82 | 72 | 5.9 | 0.996 | 0.99 |
| I | 1 | 80 | 1 | 150 | 0.1 | 70 | 15 | 0.0009 | 75 | 86 | 8.1 | 0.959 | 0.95 |
| J | 3 | 80 | 1 | 150 | 0.1 | 70 | 15 | 0.0009 | 76 | 86 | 8.2 | 0.959 | 0.95 |
| K | 1 | 80 | 1 | 150 | 0.1 | 70 | 15 | 0.0013 | 100 | 0 | 6.5 | 0.958 | 0.94 |
| L | 1 | 80 | 1 | 150 | 0.1 | 70 | 15 | 0.0001 | 45 | 62 | 7.0 | 0.966 | 0.97 |

TABLE 2-continued

| Physical properties of magnetic toners | | | | | | | | | | | | | | |
|---|---|---|---|---|---|---|---|---|---|---|---|---|---|---|
| | Prescriptions | | | | | | | Physical properties | | | | | | |
| | Magnetic iron oxide fine particles | | Polar compound | | | Wax | | | | | | | | |
| Magnetic toner No. | Kind | Addition amount (part) | Kind | Saponification value (mgKOH/g) | Addition amount (part) | Endothermic peak (° C.) | Addition amount (part) | B/A | Ratio 1(*1) | Ratio 2(*2) | Weight average particle diameter (μm) | Average circularity | Mode circularity |
| M | 3 | 80 | 1 | 150 | 0.1 | 70 | 15 | 0.0009 | 86 | 98 | 7.1 | 0.988 | 0.98 |
| N | 1 | 80 | — | — | — | 70 | 15 | 0.0002 | 85 | 32 | 6.2 | 0.990 | 1.00 |

(*1)Ratio of toner satisfying D/C ≦ 0.02 (% by number)
(*2)Ratio of toner containing 70% by number or more of magnetic iron oxide fine particles in the vicinity of toner particle surface (% by number)

EXAMPLE 1

Used as an image forming apparatus was a remodeled apparatus of LBP-1760 (manufactured by Canon Inc.) and having such a configuration as one shown in FIG. 1.

An electrostatic image bearing member (photosensitive drum) of the apparatus had a dark-part potential $V_d$ of −700 V and a light-part potential $V_L$ Of −150 V. A gap between the electrostatic image bearing member and a developing sleeve was 290 μm. Used as a toner bearing member was a developing sleeve having a resin layer with a thickness of about 7 μm (JIS central line average roughness (Ra)=1.0 μm; a layer formed by dispersing 90 parts of graphite (particle diameter about 7 μm) and 10 parts of carbon black into 100 parts of phenol resin) formed on a surface-blasted aluminum cylinder having a diameter of 16 mm. A urethane blade having a thickness of 1.0 mm and a free length of 0.5 mm was used as a toner regulating member, and was brought into contact with the developing sleeve under a linear pressure of 29.4 N/m (30 g/cm). In addition, a magnet roll to be incorporated into the developing sleeve was one having a magnetic flux density at a developing magnetic pole of 85 mT (850 gauss).

Next, a developing bias having a direct bias component $V_{dc}$ of −500 V, an alternating bias to be superimposed $V_{p-p}$ of 1,600 V, and F of 2,000 Hz was used. In addition, the circumferential speed of the developing sleeve was 110% (323 mm/sec) in the forward direction with respect to the circumferential speed of the photosensitive member (294 mm/sec). In addition, a transfer bias was DC 1.5 kV.

Used as a fixing means was a fixing unit with no oil application function of LBP-1760 and employing a method involving heat-fixation under pressure with a heater through a film. A pressurizing roller used at this time had a fluorine-based resin surface layer and a diameter of 30 mm. In addition, a fixation temperature and a nip width were set to 170° C. and 7 mm, respectively.

A 10,000-sheet image output test was performed according to an image pattern consisting of horizontal lines alone at a printing ratio of 2% by using the magnetic toner A under a normal-temperature and normal-humidity environment (23° C., 60% RH) as well as low-temperature and low-humidity environment (15° C., 10% RH). Paper of 75 g/m$^2$ was used as a transfer material.

Obtained as a result of the test was an image with no reduction in density after the 10,000-sheet image output test as compared to the density at an initial stage of the test and with no scattering. After the toner on the sleeve had been removed with air, the sleeve was visually observed and it was found that no toner adhered to the sleeve. At the same time, image densities at an initial stage and after the endurance test, an amount of fogging, dot reproducibility, and a coloring power were evaluated as follows.

(Image Density)

A solid image was formed, and then the image density of the solid image was measured with a MACBETH REFLECTION DENSITOMETER (manufactured by Macbeth).

(Fogging)

Fogging was measured by using a REFLECTMETER model TC-6DS manufactured by Tokyo Denshoku. A green filter was used, and the fogging was calculated from the following expression.

$$\text{Fogging (reflectance) (\%)} = \text{reflectance on plain paper (\%)} - \text{reflectance on sample non-image portion (\%)}$$

The evaluation criteria for fogging are as follows.

A: Very good (less than 1.5%)
B: Good (1.5% or more and less than 2.5%)
C: Normal (2.5% or more and less than 4.0%)
D: Bad (4% or more)

(Dot Reproducibility)

Figure 3:
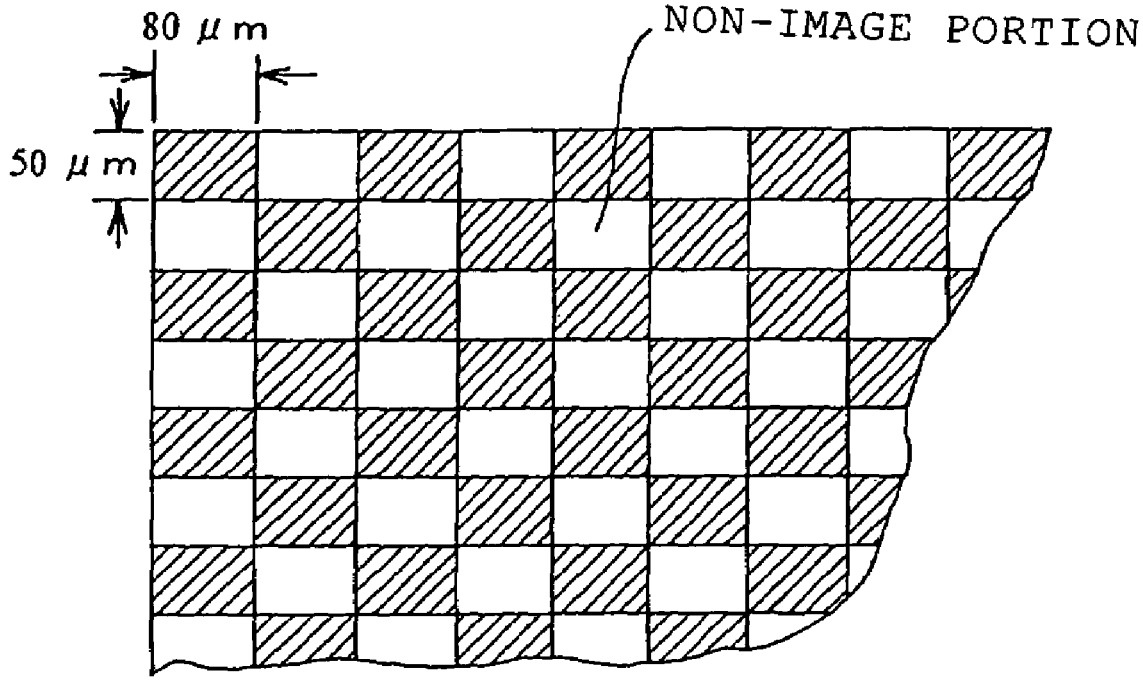
FIG. 3 is a diagram showing a checker pattern used for testing developing property of a magnetic toner.

An image output test was performed by using a checker pattern measuring 80 μm×50 μm shown in FIG. 3, and the presence or absence of defects at a black portion was observed with a microscope to evaluate dot reproducibility.

A: 2 or less defects in 100 portions
B: 3 to 5 defects in 100 portions
C: 6 to 10 defects in 100 portions
D: 11 or more defects in 100 portions (Coloring Power)

An image having multiple solid images for density measurement each measuring 10 mm×10 mm was outputted on A4 plain paper (75 g/m$^2$) for a copying machine. At this time, the toner weight per unit area of the plain paper was adjusted to 0.6 mg/cm$^2$. The image densities of five arbitrary positions on the resultant image were measured, and the coloring power was evaluated by using the average value of the image densities according to the following evaluation criteria. A "MACBETH REFLECTION DENSITOMETER" (manufactured by Macbeth) was used for the image density measurement.

A: 1.55 or more
B: 1.40 or more and less than 1.55
C: 1.20 or more and less than 1.40
D: less than 1.20

EXAMPLES 2 to 10

In each example, an image output test was performed under conditions identical to those of Example 1 by using any one of the magnetic toners B to J. As a result, initial image properties presented no problems, and each example provided a result without a serious problem until the printing of 10,000 sheets. Table 3 shows the evaluation results under a normal-temperature and normal-humidity environment while Table 4 shows the evaluation results under a low-temperature and low-humidity environment.

COMPARATIVE EXAMPLES 1 to 4

In each example, an image output test was performed under conditions identical to those of Example 1 by using any one of the magnetic toners K to N. As a result, remarkable increase of fogging occurred after the endurance tests. In particular, the dot reproducibility of the toner L significantly reduced. In addition, a remarkable reduction in image density occurred under a low-temperature and low-humidity environment. Table 3 shows the evaluation results under a normal-temperature and normal-humidity environment while Table 4 shows the evaluation results under a low-temperature and low-humidity environment.

TABLE 3

Evaluation results under a normal-temperature and normal-humidity environment

| | | Initial stage | | | | After endurance | | |
|---|---|---|---|---|---|---|---|---|
| | Toner | Image density | Fogging | Dot reproducibility | Coloring power | Image density | Fogging | Dot reproducibility |
| Example 1 | A | 1.55 | A | A | A | 1.54 | A | A |
| Example 2 | B | 1.53 | A | A | B | 1.52 | A | A |
| Example 3 | C | 1.45 | B | A | A | 1.43 | A | A |
| Example 4 | D | 1.47 | A | A | A | 1.40 | A | B |
| Example 5 | E | 1.50 | B | A | B | 1.50 | B | B |
| Example 6 | F | 1.51 | B | A | A | 1.47 | B | B |
| Example 7 | G | 1.42 | A | A | A | 1.43 | B | A |
| Example 8 | H | 1.45 | B | A | A | 1.41 | B | B |
| Example 9 | I | 1.53 | B | A | A | 1.44 | B | A |
| Example 10 | J | 1.46 | B | A | A | 1.42 | B | B |
| Comparative Example 1 | K | 1.50 | C | B | B | 1.50 | D | B |
| Comparative Example 2 | L | 1.48 | A | A | C | 1.44 | B | C |
| Comparative Example 3 | M | 1.32 | D | B | A | 1.25 | D | C |
| Comparative Example 4 | N | 1.52 | B | A | B | 1.41 | C | B |

TABLE 4

Evaluation results under a low-temperature and low-humidity environment

| | | Initial stage | | | | After endurance | | |
|---|---|---|---|---|---|---|---|---|
| | Toner | Image density | Fogging | Dot reproducibility | Coloring power | Image density | Fogging | Dot reproducibility |
| Example 1 | A | 1.55 | A | A | A | 1.48 | A | A |
| Example 2 | B | 1.54 | A | A | A | 1.54 | A | A |
| Example 3 | C | 1.45 | A | A | A | 1.43 | A | A |
| Example 4 | D | 1.48 | A | A | B | 1.39 | A | A |
| Example 5 | E | 1.50 | B | A | B | 1.50 | B | B |
| Example 6 | F | 1.51 | B | A | A | 1.47 | B | B |
| Example 7 | G | 1.42 | A | A | A | 1.43 | B | A |
| Example 8 | H | 1.45 | B | A | A | 1.41 | B | B |
| Example 9 | I | 1.53 | A | A | B | 1.44 | A | A |
| Example 10 | J | 1.35 | C | A | B | 1.51 | B | B |
| Comparative Example 1 | K | 1.50 | C | B | B | 1.23 | D | C |
| Comparative Example 2 | L | 1.48 | A | A | C | 1.28 | B | C |
| Comparative Example 3 | M | 1.30 | C | B | D | 1.05 | D | C |
| Comparative Example 4 | N | 1.52 | B | A | B | 1.25 | C | C |

Manufacture of Toner O 450 parts by mass of 0.1-mol/l aqueous solution of $Na_3PO_4$ were added to 720 parts by mass of ion-exchanged water, and the mixture was heated to 60° C. Then, 67.7 parts by mass of 1.0-mol/l aqueous solution of $CaCl_2$ were gradually added to the mixture to obtain an aqueous medium containing $Ca_3(PO_4)_2$ and having a pH of 8.5.

| | |
|---|---|
| Styrene | 74 parts |
| n-butylacrylate | 26 parts |
| Divinylbenzene | 0.5 part |
| Saturated polyester resin (polycondensate of propylene oxide modified bisphenol A and isophthalic acid; Mn = 11,000, Mw/Mn = 2.4, acid value = 30 mgKOH/g, Tg = 72° C.) | 6 parts |
| Negative charge-controlling agent (T-77; monoazo iron complex (available from Hodogaya Chemical Co., Ltd.)) | 1 part |
| Magnetic iron oxide fine particles 4 (containing 1.9 parts of coupling agent and 4.8 parts of substance having low softening point) | 101.7 parts |
| Polar compound 1 as above described | 0.1 part |

The above prescriptions were uniformly dispersed and mixed by using an ATLITER (manufactured by Mitsui Miike Machinery Co., Ltd.).

After the monomer composition had been heated to 60° C., 10 parts of polyethylene wax (maximum endothermic peak in DSC=65° C., peak width at half height of endothermic peak=17° C.) were mixed with and dissolved into the monomer composition. 4 parts of t-butyl-oxy-2-ethylhexanoate serving as a polymerization initiator were dissolved into the resultant solution to obtain a polymerizable monomer composition.

The polymerizable monomer composition was added to the aqueous medium, and the mixture was stirred by using a TK HOMOMIXER (manufactured by Tokushu Kika Kogyo Co., Ltd.) at 10,000 rpm for 15 minutes under a $N_2$ atmosphere at 60° C., followed by granulation. After that, the granulated product was allowed to react at 80° C. for 8 hours while being stuffed with a paddle stirring blade. After the completion of the reaction, the suspension was cooled, and hydrochloric acid was added to the suspension to dissolve a dispersion stabilizer. The resultant was filtrated, washed with water, and dried to obtain toner particles.

100 parts of the toner particles and 1.0 part of hydrophobic silica fine powder obtained by treating a silica having a primary particle diameter of 12 nm with hexamethyldisilazane and then with silicone oil and having a BET specific surface area after the treatments of 120 $m^2/g$ were mixed in a HENSCHEL mixer (manufactured by Mitsui Miike Machinery Co., Ltd.) to prepare a magnetic toner O. Table 5 shows the physical properties of the magnetic toner O.

Manufacture of Magnetic Toner P

A magnetic toner P was obtained in the same manner as in "Manufacture of magnetic toner O" except that the addition amount of the polar compound 1 was changed from 0.1 part to 0.05 part. Table 5 shows the physical properties of the magnetic toner P.

Manufacture of Magnetic Toner Q

A magnetic toner Q was obtained in the same manner as in "Manufacture of magnetic toner O" except that the magnetic iron oxide fine particles 4 were changed to the magnetic iron oxide fine particles 5. Table 5 shows the physical properties of the magnetic toner Q.

Manufacture of Magnetic Toner R

A magnetic toner R was obtained in the same manner as in "Manufacture of magnetic toner O" except that the magnetic iron oxide fine particles 4 were changed to the magnetic iron oxide fine particles 6. Table 5 shows the physical properties of the magnetic toner R.

Manufacture of Magnetic Toner S

A magnetic toner S was obtained in the same manner as in "Manufacture of magnetic toner O" except that: the magnetic iron oxide fine particles 4 were changed to the magnetic iron oxide fine particles 7; and the addition amount of the magnetic iron oxide fine particles was changed to 97.1 parts (containing 1.9 parts of coupling agent and 0.2 part of substance having low softening point). Table 5 shows the physical properties of the magnetic toner S.

Manufacture of Magnetic Toner T

A magnetic toner T was obtained in the same manner as in "Manufacture of magnetic toner O" except that: the magnetic iron oxide fine particles 4 were changed to the magnetic iron oxide fine particles 8; and the addition amount of the magnetic iron oxide fine particles was changed to 112.1 parts (containing 1.9 parts of coupling agent and 15.2 parts of substance having low softening point). Table 5 shows the physical properties of the magnetic toner T.

Manufacture of Magnetic Toner U

A magnetic toner U was obtained in the same manner as in "Manufacture of magnetic toner O" except that: the magnetic iron oxide fine particles 4 were changed to the magnetic iron oxide fine particles 9; and the addition amount of the magnetic iron oxide fine particles was changed to 96.9 parts (containing 1.9 parts of coupling agent). Table 5 shows the physical properties of the magnetic toner U.

Manufacture of Magnetic Toner V

A magnetic toner V was obtained in the same manner as in "Manufacture of magnetic toner O" except that the polar compound 1 (0.1 part) was changed to 5.0 parts of a polar compound 3 (styrene-methacrylic acid copolymer (styrene: methacrylic acid=95:5); saponification value=18, Mp=6, 200). Table 5 shows the physical properties of the magnetic toner V.

Manufacture of Magnetic Toner W

A magnetic toner W was obtained in the same manner as in "Manufacture of magnetic toner O" except that the polar compound 1 (0.1 part) was changed to 0.05 part of a polar compound 5 (compound represented by above general formula (2), wherein n=9, A=—$CH_2CH_2$—, R=methyl, and x:y:z=45:50:5; saponification value=220, Mp=4,300). Table 5 shows the physical properties of the magnetic toner W.

Manufacture of Magnetic Toner X

A magnetic toner X was obtained in the same manner as in "Manufacture of magnetic toner O" except that the polyethylene wax was changed to a paraffin wax (maximum endothermic peak in DSC=78° C., peak width at half height of endothermic peak=9° C., Mn=430). Table 5 shows the physical properties of the magnetic toner X.

| Manufacture of magnetic toner Y | |
|---|---|
| Styrene/n-butylacrylate copolymer (74/26 in mass ratio; Mn = 24,300, Mw/Mn = 3.0) | 100 parts |
| Saturated polyester resin (polycondensate of propylene oxide modified bisphenol A and isophthalic acid; Mn = 11,000, Mn/Mw = 2.4, acid value = 30 mgKOH/g, Tg = 72° C.) | 5 parts |
| Negative charge-controlling agent (T-77; monoazo iron complex (available from Hodogaya Chemical Co., Ltd.)) | 1 part |
| Magnetic iron oxide fine particles 4 (containing 0.6 part of coupling agent and 1.5 parts of substance having low softening point) | 32.1 parts |
| Polar compound 1 as above described | 0.1 part |
| Polyethylene wax used for manufacture of magnetic toner N | 5 parts |

The above materials were mixed in a blender, and the mixture was melt and kneaded in a biaxial extruder heated to 110° C. After the kneaded product had been cooled, the cooled kneaded product was roughly pulverized with a hammer mill. The roughly pulverized product was finely pulverized with a TURBOMILL (manufactured by Turbo Kogyo Co., Ltd.). The finely pulverized product was subjected to air classification to obtain toner particles having a weight average particle diameter of 6.0 μm.

After that, 69.6 parts of the magnetic iron oxide fine particles 4 (containing 1.3 parts of coupling agent and 3.3 parts of substance having low softening point) were externally added to 143.2 parts of the toner particles. The magnetic iron oxide fine particles 4 was fixed to the toner particle surface by using an impact-type surface treatment apparatus (treatment temperature=55° C., circumferential speed of rotary treatment blade=90 m/sec) to obtain magnetic material-fixed toner particles.

Furthermore, 8 parts of emulsion particles (styrene-methacrylic acid, Mn=6,800, Mw=32,000, particle diameter 0.05 μm) were externally added to 100 parts of the magnetic material-fixed toner particles. After that, fixing and coating of the emulsion particles were performed by using an impact-type surface treatment apparatus (treatment temperature=50° C., circumferential speed of rotary treatment blade=90 m/sec) to obtain coated toner particles. 1.0 parts of hydrophobic silica fine powder were externally added to 100 parts of the coated toner particles in the same manner as in "Manufacture of magnetic toner O" to obtain a magnetic toner Y. Table 5 shows the physical properties of the magnetic toner Y.

| Manufacture of magnetic toner Z | |
|---|---|
| Styrene/n-butylacrylate copolymer (74/26 in mass ratio; Mn = 24,300, Mw/Mn = 3.0) | 100 parts |
| Saturated polyester resin (polycondensate of propylene oxide modified bisphenol A and isophthalic acid; Mn = 11,000, Mn/Mw = 2.4, acid value = 30 mgKOH/g, Tg = 72° C.) | 5 parts |
| Negative charge-controlling agent (T-77; monoazo iron complex (available from Hodogaya Chemical Co., Ltd.)) | 1 part |
| Magnetic iron oxide fine particles 4 (containing 1.9 parts of coupling agent and 4.8 parts of substance having low softening point) | 101.7 parts |
| Polar compound 1 as above described | 0.1 part |
| Polyethylene wax used for manufacture of magnetic toner O | 5 parts |

The above materials were mixed in a blender, and the mixture was melt and kneaded in a biaxial extruder heated to 110° C. After the kneaded product had been cooled, the cooled kneaded product was roughly pulverized with a hammer mill. The roughly pulverized product was finely pulverized with a TURBOMILL (manufactured by Turbo Kogyo Co., Ltd.). The finely pulverized product was subjected to air classification to obtain toner particles having a weight average particle diameter of 6.5 μm.

1.0 part of hydrophobic silica fine powder were externally added to 100 parts of the toner particles in the same manner as in "Manufacture of magnetic toner O" to obtain a magnetic toner Z. Table 5 shows the physical properties of the magnetic toner Z.

Manufacture of Magnetic Toner AA

A magnetic toner AA was obtained in the same manner as in "Manufacture of magnetic toner O" except that: the magnetic iron oxide fine particles 10 were used instead of the magnetic iron oxide fine particles 4; the addition amount of the magnetic iron oxide fine particles was changed to 99.8 parts (containing 4.8 parts of substance having low softening point); and the addition amount of the polar compound 1 was changed to 0.1 part to 1.0 part. Table 5 shows the physical properties of the magnetic toner AA.

Manufacture of Magnetic Toner BB 25 parts of emulsion particles (styrene-methacrylic acid, Mn=6,800, Mw=32,000, particle diameter 0.05 μm) were externally added to 100 parts of the toner particles obtained in "Manufacture of magnetic toner O". After that, fixing and coating of the emulsion particles were repeatedly performed by using an impact-type surface treatment apparatus (treatment temperature=50° C., circumferential speed of rotary treatment blade=90 m/sec) to obtain coated toner particles. 1.0 parts of hydrophobic silica fine powder were externally added to 100 parts of the coated toner particles in the same manner as in "Manufacture of magnetic toner O" to obtain a magnetic toner BB. Table 5 shows the physical properties of the magnetic toner BB.

TABLE 5

| Magnetic toner No. | Physical properties of magnetic toners: Prescriptions: Magnetic iron oxide fine particles: Kind | Addition amount(*1) (part) | Polar compound: Kind | Saponification value (mgKOH/g) | Addition amount (part) | Wax: Endothermic peak (° C.) | a peak width at half height | Addition amount (part) | Physical properties: B/A | Ratio 1(*2) | Ratio 2(*3) | Weight average particle diameter (μm) | Average circularity |
|---|---|---|---|---|---|---|---|---|---|---|---|---|---|
| O | 4 | 95 | 1 | 150 | 0.1 | 65 | 17 | 10 | 0.0003 | 84 | 82 | 6.1 | 0.998 |
| P | 4 | 95 | 1 | 150 | 0.05 | 65 | 17 | 10 | 0.0004 | 76 | 56 | 5.6 | 0.997 |
| Q | 5 | 95 | 1 | 150 | 0.1 | 65 | 17 | 10 | 0.0002 | 79 | 68 | 6.8 | 0.977 |
| R | 6 | 95 | 1 | 150 | 0.1 | 65 | 17 | 10 | 0.0004 | 93 | 88 | 6.0 | 0.981 |
| S | 7 | 95 | 1 | 150 | 0.1 | 65 | 17 | 10 | 0.0007 | 84 | 84 | 6.5 | 0.979 |
| T | 8 | 95 | 1 | 150 | 0.1 | 65 | 17 | 10 | 0.0003 | 78 | 73 | 7.2 | 0.976 |
| U | 9 | 95 | 1 | 150 | 0.1 | 65 | 17 | 10 | 0.0002 | 80 | 80 | 5.4 | 0.998 |
| V | 4 | 95 | 3 | 18 | 5 | 65 | 17 | 10 | 0.0005 | 86 | 61 | 6.5 | 0.976 |
| W | 4 | 95 | 5 | 220 | 0.05 | 65 | 17 | 10 | 0.0007 | 77 | 79 | 6.6 | 0.981 |
| X | 4 | 95 | 1 | 150 | 0.1 | 78 | 9 | 10 | 0.0003 | 80 | 89 | 6.3 | 0.998 |
| Y | 4 | 95 | 1 | 150 | 0.1 | 65 | 17 | 10 | 0.0009 | 75 | 86 | 8.1 | 0.959 |
| Z | 4 | 95 | 1 | 150 | 0.1 | 65 | 17 | 10 | 0.0013 | 100 | 0 | 6.5 | 0.958 |
| AA | 10 | 95 | 1 | 150 | 1 | 65 | 17 | 10 | 0.0011 | 91 | 92 | 5.8 | 0.973 |
| BB | 4 | 95 | 1 | 150 | 0.1 | 65 | 17 | 10 | 0.0001 | 47 | 62 | 7.0 | 0.966 |

(*1)Substantial content of magnetic iron oxide fine particles except coupling agent and substance having low softening point
(*2)Ratio of toner satisfying D/C ≦ 0.02 (% by number)
(*3)Ratio of toner containing 70% by number or more of magnetic iron oxide fine particles in the vicinity of toner particle surface (% by number)

EXAMPLE 11

Used as an image forming apparatus was a remodeled apparatus of LBP-1760 and having such a configuration as one shown in FIG. 1.

An electrostatic image bearing member (photosensitive drum) of the apparatus had a dark-part potential $V_d$ of −650 V and a light-part potential $V_L$ of −130 V. A gap between the electrostatic image bearing member and a developing sleeve was 270 μm. Used as a toner bearing member was a developing sleeve having a resin layer with a thickness of about 7 μm (JIS central line average roughness (Ra)=1.0 μm; a layer formed by dispersing 90 parts of graphite (particle diameter about 7 μm) and 10 parts of carbon black into 100 parts of phenol resin) formed on a surface-blasted aluminum cylinder having a diameter of 16 mm. A urethane blade having a thickness of 1.0 mm and a free length of 0.5 mm was used as a toner regulating member, and was brought into contact with the developing sleeve under a linear pressure of 39.2 N/m (40 g/cm). In addition, a magnet roll to be incorporated into the developing sleeve was one having a magnetic flux density at a developing magnetic pole of 85 mT (850 gauss).

Next, a developing bias having a direct bias component $V_{dc}$ of −450 V, an alternating bias to be superimposed $V_{p-p}$ of 1,600 V, and F of 2,200 Hz was used. In addition, the circumferential speed of the developing sleeve was 110% (259 mm/sec) in the forward direction with respect to the circumferential speed of the photosensitive member (235 mm/sec). In addition, a transfer bias was DC 1.5 kV.

Used as a fixing means was a fixing unit with no oil application function of LBP-1760 and employing a method involving heat-fixation under pressure with a heater through a film. A pressurizing roller used at this time had a fluorine-based resin surface layer and a diameter of 30 mm. In addition, a fixation temperature and a nip width were set to 180° C. and 7 mm, respectively.

300 g of the magnetic toner O were loaded into a cartridge. Then, a 5,000-sheet image output test was performed according to an image pattern consisting of horizontal lines alone at a printing ratio of 2% under each of a normal-temperature and normal-humidity environment (23° C., 60% RH) and a low-temperature and low-humidity environment (15° C., 10% RH). Image densities at an initial stage and after the endurance test, an amount of fogging, dot reproducibility, and a coloring power were evaluated in the same manner as in Example 1. Fixability under a low-temperature and low-humidity environment was also evaluated according to the following method. Paper of 75 g/m$^2$ was used as a transfer material.

The evaluation method and judgment criteria for the fixability in this example will be described.

(Fixability)

A fixation test was performed under a normal-temperature and normal-humidity environment by using a remodeled apparatus of LBP-1760. In the fixation test, a band-like image was printed out to have an image area ratio of 25%. A toner mounting amount per unit area of an image portion was set to 0.6 mg/cm$^2$. In addition, a process speed was set to 235 mm/sec. A fixation starting temperature was measured as follows. The temperature set for a fixing unit was adjusted every 5° C. within the temperature range of 130 to 230° C., and a fixed image was outputted at each temperature. Each of the resultant fixed images was rubbed with silbon paper, to which a load of 4.9 kPa (50 g/cm$^2$) had been applied, 10 times. A fixation temperature at which a reduction in density before and after the rubbing was 10% or less was regarded as the fixation starting temperature. In addition, contamination on the image and on the back side of the paper was visually observed, and a temperature at which back-side contamination occurred was regarded as a high-temperature offset temperature.

As a result of evaluation, the magnetic toner O showed no reduction in density after the 5,000-sheet image output as compared to the density at an initial stage, and provided a good image with no fogging to a non-image portion. In addition, the magnetic toner O was excellent in low-temperature fixability and in offset resistance, thereby resulting in a wide fixation temperature range. Table 6 shows the evaluation results under a normal-temperature and normal-humidity environment while Table 7 shows the evaluation results under a low-temperature and low-humidity environment.

EXAMPLES 12 to 21

In each example, an image output test, fixability evaluation, and durability evaluation were performed under conditions identical to those of Example 11 by using any one of the magnetic toners P to Y. As a result, initial image properties presented no problems, and each example provided a result without a serious problem until the printing of 5,000 sheets. However, the magnetic toner U provided a narrow fixation region. Table 6 shows the evaluation results under a normal-temperature and normal-humidity environment while Table 7 shows the evaluation results under a low-temperature and low-humidity environment.

COMPARATIVE EXAMPLES 5 to 7

In each comparative example, an image output test, fixability evaluation, and durability evaluation were performed under conditions identical to those of Example 11 by using any one of the magnetic toners Z, AA, and BB. As a result, in the magnetic toner Z, increase of fogging occurred as the endurance test proceeded. In particular, a remarkable reduction in image density occurred under a low-temperature and low-humidity environment. Furthermore, the magnetic toner BB provided a narrow fixation region. Table 6 shows the evaluation results under a normal-temperature and normal-humidity environment while Table 7 shows the evaluation results under a low-temperature and low-humidity environment.

TABLE 6

Results under a normal-temperature and normal-humidity environment

| | | Fixation temperature (° C.) | | Initial stage | | | | After endurance | | |
|---|---|---|---|---|---|---|---|---|---|---|
| | Toner | Starting temperature | High-temperature offset temperature | Image density | Fogging | Dot reproducibility | Coloring power | Image density | Fogging | Dot reproducibility |
| Example 11 | O | 135 | >230 | 1.54 | A | A | A | 1.53 | A | A |
| Example 12 | P | 140 | >230 | 1.53 | A | A | B | 1.52 | A | A |
| Example 13 | Q | 160 | 230 | 1.49 | A | A | B | 1.46 | A | B |
| Example 14 | R | 130 | 195 | 1.53 | A | A | A | 1.52 | A | A |
| Example 15 | S | 135 | 190 | 1.53 | A | A | A | 1.51 | A | A |
| Example 16 | T | 150 | >230 | 1.42 | B | B | C | 1.37 | B | B |
| Example 17 | U | 160 | 190 | 1.55 | A | A | A | 1.54 | A | A |
| Example 18 | V | 135 | 230 | 1.51 | B | A | A | 1.47 | B | B |
| Example 19 | W | 140 | >230 | 1.43 | A | B | C | 1.39 | B | B |
| Example 20 | X | 150 | >230 | 1.54 | A | A | A | 1.54 | A | A |
| Example 21 | Y | 150 | 225 | 1.53 | B | A | A | 1.44 | B | A |
| Comparative Example 5 | Z | 150 | 215 | 1.50 | C | B | B | 1.50 | D | B |
| Comparative Example 6 | AA | 145 | 230 | 1.45 | B | A | A | 1.43 | A | A |
| Comparative Example 7 | BB | 150 | 225 | 1.48 | A | A | C | 1.44 | B | C |

TABLE 7

Results under a low-temperature and low-humidity environment

| | | Initial stage | | | | After endurance | | |
|---|---|---|---|---|---|---|---|---|
| | Toner | Image density | Fogging | Dot reproducibility | Coloring power | Image density | Fogging | Dot reproducibility |
| Example 11 | O | 1.53 | A | A | A | 1.50 | A | A |
| Example 12 | P | 1.54 | A | A | A | 1.54 | A | A |
| Example 13 | Q | 1.49 | A | A | B | 1.44 | B | B |
| Example 14 | R | 1.50 | A | A | A | 1.50 | A | A |
| Example 15 | S | 1.52 | A | A | A | 1.52 | A | A |
| Example 16 | T | 1.43 | B | B | C | 1.36 | C | B |
| Example 17 | U | 1.55 | A | A | A | 1.48 | A | A |
| Example 18 | V | 1.51 | B | A | A | 1.47 | B | B |
| Example 19 | W | 1.41 | A | B | C | 1.42 | C | C |
| Example 20 | X | 1.52 | A | A | A | 1.51 | A | A |
| Example 21 | Y | 1.53 | B | A | B | 1.44 | A | A |
| Comparative Example 5 | Z | 1.50 | C | B | B | 1.23 | D | C |

TABLE 7-continued

| | | Results under a low-temperature and low-humidity environment | | | | | | |
|---|---|---|---|---|---|---|---|---|
| | | Initial stage | | | | After endurance | | |
| | Toner | Image density | Fogging | Dot reproducibility | Coloring power | Image density | Fogging | Dot reproducibility |
| Comparative Example 6 | AA | 1.45 | A | A | A | 1.43 | A | A |
| Comparative Example 7 | BB | 1.48 | A | A | C | 1.33 | B | C |

This invention being thus described, it will be obvious that same may be varied in various ways. Such variations are not to be regarded as departure from the spirit and scope of the invention, and all such modifications would be obvious for one skilled in the art intended to be included within the scope of the following claims.

This application claims priority from Japanese Patent Application No. 2003-321825 filed Sep. 12, 2003, which is hereby incorporated by reference herein.

What is claimed is:

1. A magnetic toner comprising toner particles each containing at least a binder resin, a polar compound and a magnetic iron oxide fine particle, wherein:

I) a ratio (B/A) of an iron element content (B) to a carbon element content (A) present on the surface of the toner particle, measured by X-ray photoelectron spectroscopy, is less than 0.0010;

II) when a projected area diameter of toner particles obtained through cross-section observation of the toner particles using a transmission electron microscope (TEM) is denoted by C and a minimum value for a distance between a magnetic iron oxide fine particle and the toner particle surface is denoted by D, toner particles each satisfying a relationship of $D/C \leqq 0.02$ are present in an amount of 50% by number or more;

III) in the cross-section observation of the toner particles, toner particles, which satisfy a structure where 70% by number or more of the magnetic iron oxide fine particles in the respective toner particles are present up to a depth of 0.2 times as far as the projected area diameter C from the toner particle surface, are present in an amount of 40 to 95% by number; and IV) wherein the polar compound contains a maleic anhydride copolymer represented by following general formula (1) or a ring-opened compound of the maleic anhydride copolymer (1)

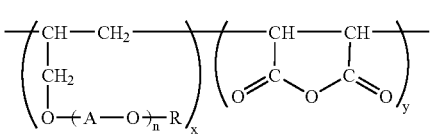

wherein A represents an alkylene group, R represents a hydrogen atom or an alkyl group having 1 to 20 carbon atoms, n represents an integer of 1 to 20, x and y each represent a copolymerization ratio of each component, and x:y is from 10:90 to 90:10.

2. The magnetic toner according to claim 1, wherein in the cross-section observation of the toner particles, a content of toner particles, which satisfy a structure where 70% by number or more of the magnetic iron oxide fine particles in the respective toner particles are present up to a depth of 0.2 times as far as the projected area diameter C from the toner particle surface, is in a range of 60 to 95% by number.

3. The magnetic toner according to claim 1, wherein the ratio (B/A) of the iron element content (B) to the carbon element content (A) present on the surface of toner particle is less than 0.0005.

4. The magnetic toner according to claim 1, wherein toner particles each satisfying the relationship of $D/C \leqq 0.02$ are present in an amount of 75% by number or more.

5. The magnetic toner according to claim 1, wherein the toner particles have an average circularity is 0.970 or more.

6. The magnetic toner according to claim 1, wherein a content of the magnetic iron oxide fine particles is in a range of 10 to 200 parts by mass with respect to 100 parts by mass of the binder resins.

7. The magnetic toner according to claim 1, wherein the toner particles have a weight average particle diameter is in a range of 2 to 10 μm.

8. The magnetic toner according to claim 1, wherein the polar compound comprises a compound having a saponification value in a range of 20 to 200.

9. The magnetic toner according to claim 1, wherein a content of the polar compounds is in a range of 0.001 to 10 parts by mass with respect to 100 parts by mass of the binder resins.

10. A method for manufacturing a magnetic toner comprising toner particles each containing at least a binder resin and a magnetic iron oxide fine particle, the method comprising the steps of:

1) preparing a polymerizable monomer composition containing at least a polymerizable monomer, a magnetic iron oxide fine particle, and a polar compound containing a maleic anhydride copolymer represented by following general formula (1) or a ring-opened compound of the maleic anhydride copolymer;

(1)

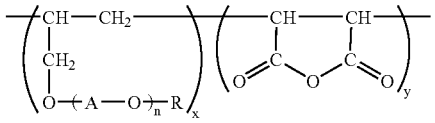

wherein A represents an alkylene group, R represents a hydrogen atom or an alkyl group having 1 to 20 carbon atoms, n represents an integer of 1 to 20, x and y each represent a copolymerization ratio of each component, and x:y is from 10:90 to 90:10.

2) dispersing the prepared polymerizable monomer composition into an aqueous medium for granulation; and 3) subjecting the granulated polymerizable monomer composition to suspension polymerization to obtain toner particles, wherein in the resultant magnetic toner:

I) a ratio (B/A) of an iron element content (B) to a carbon element content (A) present on the surface of the toner particle, measured by X-ray photoelectron spectroscopy is less than 0.0010;

II) when a projected area diameter of toner particles obtained through cross-section observation of the toner particles using a transmission electron microscope (TEM) is denoted by C and a minimum value for a distance between a magnetic iron oxide fine particle and the toner particle surface is denoted by D, toner particles each satisfying a relationship of D/C≦0.02 are present in an amount of 50% by number or more; and III) in the cross-section observation of the toner particles, toner particles, which satisfy a structure where 70% by number or more of the magnetic iron oxide fine particles in the respective toner particles are present up to a depth of 0.2 times as far as the projected area diameter C from the toner particle surface, are present in an amount of 40 to 95% by number.

11. The method for manufacturing a magnetic toner according to claim 10, wherein the polar compound comprises a compound having a saponification value in a range of 20 to 200.

12. The method for manufacturing a magnetic toner according to claim 10, wherein a content of the polar compounds is in a range of 0.001 to 10 parts by mass with respect to 100 parts by mass of the binder resins.

13. A magnetic toner comprising toner particles each containing at least a binder resin, a polar compound and a magnetic iron oxide fine particle, wherein:

I) a ratio (B/A) of an iron element content (B) to a carbon element content (A) present on the surface of the toner particle, measured by X-ray photoelectron spectroscopy, is less than 0.0010;

II) when a projected area diameter of toner particles obtained through cross-section observation of the toner particles using a transmission electron microscope (TEM) is denoted by C and a minimum value for a distance between a magnetic iron oxide fine particle and the toner particle surface is denoted by D, toner particles each satisfying a relationship of D/C≦0.02 are present in an amount of 50% by number or more;

III) in the cross-section observation of the toner particles, toner particles, which satisfy a structure where 70% by number or more of the magnetic iron oxide fine particles in the respective toner particles are present up to a depth of 0.2 times as far as the projected area diameter C from the toner particle surface, are present in an amount of 40 to 95% by number; and IV) wherein the polar compound contains a maleic anhydride copolymer represented by following general formula (2) or a ring-opened compound of the maleic anhydride copolymer (2)

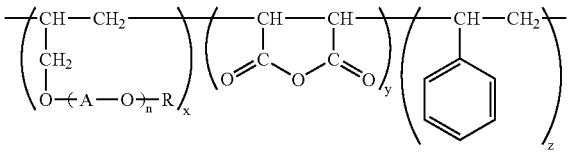

wherein A represents an alkylene group, R represents a hydrogen atom or an alkyl group having 1 to 20 carbon atoms, n represents an integer of 1 to 20, x, y, and z each represent a copolymerization ratio of each component, x:y is from 10:90 to 90:10, and (x+y):z is from 50:50 to 99.9:0.1.

14. The magnetic toner according to claim 13, wherein in the cross-section observation of the toner particles, a content of toner particles, which satisfy a structure where 70% by number or more of the magnetic iron oxide fine particles in the respective toner particles are present up to a depth of 0.2 times as far as the projected area diameter C from the toner particle surface, is in a range of 60 to 95% by number.

15. The magnetic toner according to claim 13, wherein the ratio (B/A) of the iron element content (B) to the carbon element content (A) present on the surface of toner particle is less than 0.0005.

16. The magnetic toner according to claim 13, wherein toner particles each satisfying the relationship of D/C≦0.02 are present in an amount of 75% by number or more.

17. The magnetic toner according to claim 13, wherein the toner particles have an average circularity is 0.970 or more.

18. The magnetic toner according to claim 13, wherein a content of the magnetic iron oxide fine particles is in a range of 10 to 200 parts by mass with respect to 100 parts by mass of the binder resins.

19. The magnetic toner according to claim 13, wherein the toner particles have a weight average particle diameter is in a range of 2 to 10 μm.

20. The magnetic toner according to claim 13, wherein the polar compound comprises a compound having a saponification value in a range of 20 to 200.

21. The magnetic toner according to claim 13, wherein a content of the polar compounds is in a range of 0.001 to 10 parts by mass with respect to 100 parts by mass of the binder resins.

22. A method for manufacturing a magnetic toner comprising toner particles each containing at least a binder resin and a magnetic iron oxide fine particle, the method comprising the steps of:

1) preparing a polymerizable monomer composition containing at least a polymerizable monomer, a magnetic iron oxide fine particle, and a polar compound;

2) dispersing the prepared polymerizable monomer composition into an aqueous medium for granulation; and 3) subjecting the granulated polymerizable monomer composition to suspension polymerization to obtain toner particles, wherein in the resultant magnetic toner:

I) a ratio (B/A) of an iron element content (B) to a carbon element content (A) present on the surface of the toner particle, measured by X-ray photoelectron spectroscopy is less than 0.0010;

II) when a projected area diameter of toner particles obtained through cross-section observation of the toner particles using a transmission electron microscope (TEM) is denoted by C and a minimum value for a distance between a magnetic iron oxide fine particle and the toner particle surface is denoted by D, toner particles each satisfying a relationship of D/C≦0.02 are present in an amount of 50% by number or more;

III) in the cross-section observation of the toner particles, toner particles, which satisfy a structure where 70% by number or more of the magnetic iron oxide fine particles in the respective toner particles are present up to a depth of 0.2 times as far as the projected area diameter C from the toner particle surface, are present in an amount of 40 to 95% by number; and IV) wherein the polar compound contains a maleic anhydride copolymer represented by following general formula (2) or a ring-opened compound of the maleic anhydride copolymer (2)

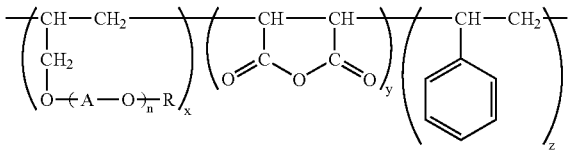

wherein A represents an alkylene group, R represents a hydrogen atom or an alkyl group having 1 to 20 carbon atoms, n represents an integer of 1 to 20, x, y, and z each represent a copolymerization ratio of each component, x:y is from 10:90 to 90:10, and (x+y):z is from 50:50 to 99.9:0.1.

23. The method for manufacturing a magnetic toner according to claim 22, wherein the polar compound comprises a compound having a saponification value in a range of 20 to 200.

24. The method for manufacturing a magnetic toner according to claim 22, wherein a content of the polar compounds is in a range of 0.001 to 10 parts by mass with respect to 100 parts by mass of the binder resins.

* * * * *

UNITED STATES PATENT AND TRADEMARK OFFICE

CERTIFICATE OF CORRECTION

PATENT NO. : 7,371,494 B2
APPLICATION NO. : 10/938590
DATED : May 13, 2008
INVENTOR(S) : Tatsuhiko Chiba et al.

It is certified that error appears in the above-identified patent and that said Letters Patent is hereby corrected as shown below:

COLUMN 24:

Line 62, "COULTER" should read --A COULTER--.

COLUMN 30:

Line 58, "stuffed" should read --stirred--;
Line 59, "stuffed" should read --stirred--; and
Line 63, "$(P_{\phi 4})_2$." should read --$(PO_4)_z$.--.

COLUMN 35:

Line 28, "$V_L$ Of" should read --$V_L$ of--; and
Line 45, "$V_{ac}$ of" should read --$V_{dc}$ of--.

COLUMN 39:

Line 41, "stuffed" should read --stirred--.

COLUMN 43:

Line 55, "$V_{ac}$ of" should read --$V_{dc}$ of--.

COLUMN 48:

Line 27, "circularity is" should read --circularity of--; and
Line 33, "diameter is in" should read --diameter in--.

UNITED STATES PATENT AND TRADEMARK OFFICE

CERTIFICATE OF CORRECTION

PATENT NO. : 7,371,494 B2
APPLICATION NO. : 10/938590
DATED : May 13, 2008
INVENTOR(S) : Tatsuhiko Chiba et al.

It is certified that error appears in the above-identified patent and that said Letters Patent is hereby corrected as shown below:

COLUMN 50:

Line 34, "circularity is" should read --circularity of--; and
Line 41, "diameter is in" should read --diameter in--.

Signed and Sealed this

Twenty-eighth Day of October, 2008

JON W. DUDAS
*Director of the United States Patent and Trademark Office*